US006919876B1

(12) United States Patent
Kawaguchi et al.

(10) Patent No.: US 6,919,876 B1
(45) Date of Patent: Jul. 19, 2005

(54) DRIVING METHOD AND DRIVING DEVICE FOR A DISPLAY DEVICE

(75) Inventors: Kazuyoshi Kawaguchi, Yokohama (JP); Makoto Nagai, Yokohama (JP)

(73) Assignee: OPTREX Corporation, Tokyo (JP)

( * ) Notice: Subject to any disclaimer, the term of this patent is extended or adjusted under 35 U.S.C. 154(b) by 0 days.

(21) Appl. No.: 09/512,817

(22) Filed: Feb. 25, 2000

(30) Foreign Application Priority Data

Feb. 26, 1999 (JP) ..... 11-051914
Mar. 11, 1999 (JP) ..... 11-065686
Mar. 15, 1999 (JP) ..... 11-067862

(51) Int. Cl.[7] ..... G09G 3/36
(52) U.S. Cl. ..... 345/103
(58) Field of Search ..... 345/86–103, 147; 340/784

(56) References Cited

U.S. PATENT DOCUMENTS 4,608,558 A * 8/1986 Amstutz et al. ..... 340/784
5,508,716 A * 4/1996 Prince et al. ..... 345/103
5,642,133 A * 6/1997 Scheffer et al. ..... 345/147
5,852,429 A * 12/1998 Scheffer et al. ..... 345/100
5,861,869 A * 1/1999 Scheffer et al. ..... 345/147
6,084,563 A * 7/2000 Ito et al. ..... 345/100

FOREIGN PATENT DOCUMENTS

JP 408044317 A * 2/1996 ..... G09G/3/36

OTHER PUBLICATIONS

Jurgen Nehring et al, May 1979, IEEE Transactions, vol. Ed–26, No. 5, Ultimage Limits for Matrix Addressing of RMS–Responding Liquid–Crystal Displays, pp. 795–802.*
T.N. Ruckmongathan, International Display Research Conference, 1988, A Generalized Addressing Technique for RMS Responding Matrix LCDs, pp. 80–85.*

* cited by examiner

*Primary Examiner*—Sumati Lefkowitz
*Assistant Examiner*—Srilakshmi K. Kumar
(74) *Attorney, Agent, or Firm*—Oblon, Spivak, McClelland, Maier & Neustadt, P.C.

(57) ABSTRACT

The liquid crystal display device includes a MLA operating circuit which reads from gradation data of [b2, b1, b0] stored in frame memories b2 in a period of the first frame, and b1 and b0 in periods T1 and T0 of the second frame to produce a column data signal 104 ([c2, c1, c0]), and a timing control circuit which controls a latch signal to column drivers so that the time ratio of the first frame to the second frame is 4:3 and the time ration of divided selection periods in the second frame is 2:1. With this, the number of change points of voltage level applicable in selection periods can be reduced whereby occurrence of a waveform distortion is minimized and a possibility of an uneven display in the liquid crystal display device is reduced.

21 Claims, 35 Drawing Sheets

| GRADATION DATA [b2,b1,b0] | GRADATION LEVEL | SELECTION PERIOD OF FIRST FRAME T3 | SELECTION PERIOD OF FIRST FRAME T0 | SELECTION PERIOD OF SECOND FRAME T2 | SELECTION PERIOD OF SECOND FRAME T1 |
|---|---|---|---|---|---|
| [1111] | 15/15 | 1 | 1 | 1 | 1 |
| [1100] | 14/15 | 1 | 0 | 1 | 1 |
| [1101] | 13/15 | 1 | 1 | 1 | 0 |
| [1100] | 12/15 | 1 | 0 | 1 | 0 |
| [1011] | 11/15 | 1 | 1 | 0 | 1 |
| [1010] | 10/15 | 1 | 0 | 0 | 1 |
| [1001] | 9/15 | 1 | 1 | 0 | 0 |
| [1000] | 8/15 | 1 | 0 | 0 | 0 |
| [0111] | 7/15 | 0 | 1 | 1 | 1 |
| [0110] | 6/15 | 0 | 0 | 1 | 1 |
| [0101] | 5/15 | 0 | 1 | 1 | 0 |
| [0100] | 4/15 | 0 | 0 | 1 | 0 |
| [0011] | 3/15 | 0 | 1 | 0 | 1 |
| [0010] | 2/15 | 0 | 0 | 0 | 1 |
| [0001] | 1/15 | 0 | 1 | 0 | 0 |
| [0000] | 0/15 | 0 | 0 | 0 | 0 |

4 x 4 HADAMARD'S MATRIX (A)

| | | | | |
|---|---|---|---|---|
| L=1 | 1 | 1 | 1 | 1 |
| L=2 | 1 | -1 | 1 | -1 |
| L=3 | 1 | 1 | -1 | -1 |
| L=4 | 1 | -1 | -1 | 1 |

COLUMN ELECTRODE 1

VECTOR (d) (-1 -1 -1 -1)
VECTOR (v) (-4 0 0 0)

COLUMN ELECTRODE 2

VECTOR (d) (-1 1 1 1)
VECTOR (v) ( 2 -2 -2 -2)

Fig. 3

| GRADATION LEVEL | SELECTION PERIOD OF FIRST FRAME | | SELECTION PERIOD OF SECOND FRAME | |
|---|---|---|---|---|
| | T1 | T0 | T1 | T0 |
| 6/6 | 1 | 1 | 1 | 1 |
| 5/6 | 1 | 1 | 1 | 0 |
| 4/6 | 1 | 1 | 0 | 1 |
| 3/6 | 1 | 1 | 0 | 0 |
| 2/6 | 1 | 0 | 0 | 0 |
| 1/6 | 0 | 1 | 0 | 0 |
| 0/6 | 0 | 0 | 0 | 0 |

Fig. 5

| | SELECTION PERIOD OF FIRST FRAME | |
|---|---|---|
| | T1 | T0 |
| L1 (3/6) | 1 | 1 |
| L2 (2/6) | 1 | 0 |
| L3 (1/6) | 0 | 1 |
| L4 (0/6) | 0 | 0 |

Fig. 6

4 x 4 HADAMARD'S MATRIX (A)

| | | | | |
|---|---|---|---|---|
| L=1 | 1 | 1 | 1 | 1 |
| L=2 | 1 | -1 | 1 | -1 |
| L=3 | 1 | 1 | -1 | -1 |
| IMAGINARY ROW | 1 | -1 | -1 | 1 |

COLUMN ELECTRODE i
VECTOR (d) (-1 -1 -1 1)
VECTOR (v) (-2 -2 -2 2)

COLUMN ELECTRODE j
VECTOR (d) (-1 1 1 1)
VECTOR (v) (2 -2 -2 -2)

| GRADATION DATA [b2,b1,b0] | GRADATION LEVEL | SELECTION PERIOD OF FIRST FRAME | | SELECTION PERIOD OF SECOND FRAME | |
|---|---|---|---|---|---|
| | | T3 | T0 | T2 | T1 |
| [1111] | 15/15 | 1 | 1 | 1 | 1 |
| [1100] | 14/15 | 1 | 0 | 1 | 1 |
| [1101] | 13/15 | 1 | 1 | 1 | 0 |
| [1100] | 12/15 | 1 | 0 | 1 | 0 |
| [1011] | 11/15 | 1 | 1 | 0 | 1 |
| [1010] | 10/15 | 1 | 0 | 0 | 1 |
| [1001] | 9/15 | 1 | 1 | 0 | 0 |
| [1000] | 8/15 | 1 | 0 | 0 | 0 |
| [0111] | 7/15 | 0 | 1 | 1 | 1 |
| [0110] | 6/15 | 0 | 0 | 1 | 1 |
| [0101] | 5/15 | 0 | 1 | 1 | 0 |
| [0100] | 4/15 | 0 | 0 | 1 | 0 |
| [0011] | 3/15 | 0 | 1 | 0 | 1 |
| [0010] | 2/15 | 0 | 0 | 0 | 1 |
| [0001] | 1/15 | 0 | 1 | 0 | 0 |
| [0000] | 0/15 | 0 | 0 | 0 | 0 |

Fig. 15

| GRADATION NUMBER | f1 | f2 | | f3 | f4 | | |
|---|---|---|---|---|---|---|---|
| | T2 | T1 | T0 | T2 | T1 | T0 | GRADATION LEVEL |
| 0 | 0 | 0 | 0 | 0 | 0 | 0 | 0 /20 |
| 1 | 0 | 0 | 1 | 0 | 0 | 0 | 1 /20 |
| 2 | 0 | 0 | 1 | 0 | 0 | 1 | 2 /20 |
| 3 | 0 | 1 | 0 | 0 | 0 | 0 | 3 /20 |
| 4 | 0 | 1 | 1 | 0 | 0 | 0 | 4 /20 |
| 5 | 0 | 1 | 1 | 0 | 0 | 1 | 5 /20 |
| 6 | 1 | 0 | 0 | 0 | 0 | 0 | 6 /20 |
| 7 | 1 | 0 | 1 | 0 | 0 | 0 | 7 /20 |
| 8 | 1 | 0 | 1 | 0 | 0 | 1 | 8 /20 |
| 9 | 1 | 1 | 0 | 0 | 0 | 0 | 9 /20 |
| 10 | 1 | 1 | 1 | 0 | 0 | 0 | 10 /20 |
| 11 | 1 | 1 | 1 | 0 | 0 | 1 | 11 /20 |
| 12 | 1 | 1 | 0 | 0 | 1 | 0 | 12 /20 |
| 13 | 1 | 1 | 1 | 0 | 1 | 0 | 13 /20 |
| 14 | 1 | 1 | 1 | 0 | 1 | 1 | 14 /20 |
| 15 | 1 | 1 | 0 | 1 | 0 | 0 | 15 /20 |
| 16 | 1 | 1 | 1 | 1 | 0 | 0 | 16 /20 |
| 17 | 1 | 1 | 1 | 1 | 0 | 1 | 17 /20 |
| 18 | 1 | 1 | 0 | 1 | 1 | 0 | 18 /20 |
| 19 | 1 | 1 | 1 | 1 | 1 | 0 | 19 /20 |
| 20 | 1 | 1 | 1 | 1 | 1 | 1 | 20 /20 |

| GRADATION NUMBER | f1 | f2 | | f3 | f4 | | |
|---|---|---|---|---|---|---|---|
| | T2 | T1 | T0 | T2 | T1 | T0 | GRADTION LEVEL |
| 0 | 0 | 0 | 0 | 0 | 0 | 0 | 0 /20 |
| 1 | 0 | 0 | 1 | 0 | 0 | 0 | 2 /20 |
| 2 | 0 | 1 | 0 | 0 | 0 | 0 | 3 /20 |
| 3 | 0 | 0 | 1 | 0 | 0 | 1 | 4 /20 |
| 4 | 0 | 1 | 1 | 0 | 0 | 0 | 5 /20 |
| 5 | 1 | 0 | 0 | 0 | 0 | 0 | 6 /20 |
| 6 | 0 | 1 | 1 | 0 | 0 | 1 | 7 /20 |
| 7 | 1 | 0 | 1 | 0 | 0 | 0 | 8 /20 |
| 8 | 1 | 1 | 0 | 0 | 0 | 0 | 9 /20 |
| 9 | 1 | 0 | 1 | 0 | 0 | 1 | 10 /20 |
| 10 | 1 | 1 | 1 | 0 | 0 | 0 | 11 /20 |
| 11 | 1 | 1 | 0 | 0 | 1 | 0 | 12 /20 |
| 12 | 1 | 1 | 1 | 0 | 0 | 1 | 13 /20 |
| 13 | 1 | 1 | 1 | 0 | 1 | 0 | 14 /20 |
| 14 | 1 | 1 | 0 | 1 | 0 | 0 | 15 /20 |
| 15 | 1 | 1 | 1 | 0 | 1 | 1 | 16 /20 |
| 16 | 1 | 1 | 1 | 1 | 0 | 0 | 17 /20 |
| 17 | 1 | 1 | 0 | 1 | 1 | 0 | 18 /20 |
| 18 | 1 | 1 | 1 | 1 | 0 | 1 | 19 /20 |
| 19 | 1 | 1 | 1 | 1 | 1 | 0 | 20 /20 |
| 20 | 1 | 1 | 1 | 1 | 1 | 1 | 22 /20 |

Fig. 18

| GRADATION NUMBER | f1 | | f2 | | f3 | | f4 | | |
|---|---|---|---|---|---|---|---|---|---|
| | T3 | T0 | T2 | T1 | T3 | T0 | T2 | T1 | GRADATION LEVEL |
| 0 | 0 | 0 | 0 | 0 | 0 | 0 | 0 | 0 | 0 /44 |
| 1 | 0 | 1 | 0 | 0 | 0 | 0 | 0 | 0 | 1 /44 |
| 2 | 0 | 1 | 0 | 0 | 0 | 1 | 0 | 0 | 2 /44 |
| 3 | 0 | 0 | 0 | 1 | 0 | 0 | 0 | 0 | 3 /44 |
| 4 | 0 | 1 | 0 | 1 | 0 | 0 | 0 | 0 | 4 /44 |
| 5 | 0 | 1 | 0 | 1 | 0 | 1 | 0 | 0 | 5 /44 |
| 6 | 0 | 0 | 1 | 0 | 0 | 0 | 0 | 0 | 6 /44 |
| 7 | 0 | 1 | 1 | 0 | 0 | 0 | 0 | 0 | 7 /44 |
| 8 | 0 | 1 | 1 | 0 | 0 | 1 | 0 | 0 | 8 /44 |
| 9 | 0 | 0 | 1 | 1 | 0 | 0 | 0 | 0 | 9 /44 |
| 10 | 0 | 1 | 1 | 1 | 0 | 0 | 0 | 0 | 10 /44 |
| 11 | 0 | 1 | 1 | 1 | 0 | 1 | 0 | 0 | 11 /44 |
| 12 | 1 | 0 | 0 | 0 | 0 | 0 | 0 | 0 | 12 /44 |
| 13 | 1 | 1 | 0 | 0 | 0 | 0 | 0 | 0 | 13 /44 |
| 14 | 1 | 1 | 0 | 0 | 0 | 1 | 0 | 0 | 14 /44 |
| 15 | 1 | 0 | 0 | 1 | 0 | 0 | 0 | 0 | 15 /44 |
| 16 | 1 | 1 | 0 | 1 | 0 | 0 | 0 | 0 | 16 /44 |
| 17 | 1 | 1 | 0 | 1 | 0 | 1 | 0 | 0 | 17 /44 |
| 18 | 1 | 0 | 1 | 0 | 0 | 0 | 0 | 0 | 18 /44 |
| 19 | 1 | 1 | 1 | 0 | 0 | 0 | 0 | 0 | 19 /44 |
| 20 | 1 | 1 | 1 | 0 | 0 | 1 | 0 | 0 | 20 /44 |
| 21 | 1 | 0 | 1 | 1 | 0 | 0 | 0 | 0 | 21 /44 |
| 22 | 1 | 1 | 1 | 1 | 0 | 0 | 0 | 0 | 22 /44 |
| 23 | 1 | 1 | 1 | 1 | 0 | 1 | 0 | 0 | 23 /44 |
| 24 | 1 | 0 | 1 | 1 | 0 | 0 | 0 | 1 | 24 /44 |
| 25 | 1 | 1 | 1 | 1 | 0 | 0 | 0 | 1 | 25 /44 |
| 26 | 1 | 1 | 1 | 1 | 0 | 1 | 0 | 1 | 26 /44 |
| 27 | 1 | 0 | 1 | 1 | 0 | 0 | 1 | 0 | 27 /44 |
| 28 | 1 | 1 | 1 | 1 | 0 | 0 | 1 | 0 | 28 /44 |
| 29 | 1 | 1 | 1 | 1 | 0 | 1 | 1 | 0 | 29 /44 |
| 30 | 1 | 0 | 1 | 1 | 0 | 0 | 1 | 1 | 30 /44 |
| 31 | 1 | 1 | 1 | 1 | 0 | 0 | 1 | 1 | 31 /44 |
| 32 | 1 | 1 | 1 | 1 | 0 | 1 | 1 | 1 | 32 /44 |
| 33 | 1 | 0 | 1 | 1 | 1 | 0 | 0 | 0 | 33 /44 |
| 34 | 1 | 1 | 1 | 1 | 1 | 0 | 0 | 0 | 34 /44 |
| 35 | 1 | 1 | 1 | 1 | 1 | 1 | 0 | 0 | 35 /44 |
| 36 | 1 | 0 | 1 | 1 | 1 | 0 | 0 | 1 | 36 /44 |
| 37 | 1 | 1 | 1 | 1 | 1 | 0 | 0 | 1 | 37 /44 |
| 38 | 1 | 1 | 1 | 1 | 1 | 1 | 0 | 1 | 38 /44 |
| 39 | 1 | 0 | 1 | 1 | 1 | 0 | 1 | 0 | 39 /44 |
| 40 | 1 | 1 | 1 | 1 | 1 | 0 | 1 | 0 | 40 /44 |
| 41 | 1 | 1 | 1 | 1 | 1 | 1 | 1 | 0 | 41 /44 |
| 42 | 1 | 0 | 1 | 1 | 1 | 0 | 1 | 1 | 42 /44 |
| 43 | 1 | 1 | 1 | 1 | 1 | 0 | 1 | 1 | 43 /44 |
| 44 | 1 | 1 | 1 | 1 | 1 | 1 | 1 | 1 | 44 /44 |

Fig. 21

| GRADATION NUMBER | f1 | | f2 | | f3 | | f4 | | GRADATION LEVEL |
|---|---|---|---|---|---|---|---|---|---|
| | T3 | T0 | T2 | T1 | T3 | T0 | T2 | T1 | |
| 0 | 0 | 0 | 0 | 0 | 0 | 0 | 0 | 0 | 0 /46 |
| 1 | 0 | 1 | 0 | 0 | 0 | 0 | 0 | 0 | 2 /46 |
| 2 | 0 | 0 | 0 | 1 | 0 | 0 | 0 | 0 | 3 /46 |
| 3 | 0 | 1 | 0 | 0 | 0 | 1 | 0 | 0 | 4 /46 |
| 4 | 0 | 1 | 0 | 1 | 0 | 0 | 0 | 0 | 5 /46 |
| 5 | 0 | 0 | 1 | 0 | 0 | 0 | 0 | 0 | 6 /46 |
| 6 | 0 | 1 | 0 | 1 | 0 | 1 | 0 | 0 | 7 /46 |
| 7 | 0 | 1 | 1 | 0 | 0 | 0 | 0 | 0 | 8 /46 |
| 8 | 0 | 0 | 1 | 1 | 0 | 0 | 0 | 0 | 9 /46 |
| 9 | 0 | 1 | 1 | 0 | 0 | 1 | 0 | 0 | 10 /46 |
| 10 | 0 | 1 | 1 | 1 | 0 | 0 | 0 | 0 | 11 /46 |
| 11 | 1 | 0 | 0 | 0 | 0 | 0 | 0 | 0 | 12 /46 |
| 12 | 0 | 1 | 1 | 1 | 0 | 1 | 0 | 0 | 13 /46 |
| 13 | 1 | 1 | 0 | 0 | 0 | 0 | 0 | 0 | 14 /46 |
| 14 | 1 | 0 | 0 | 1 | 0 | 0 | 0 | 0 | 15 /46 |
| 15 | 1 | 1 | 0 | 0 | 0 | 1 | 0 | 0 | 16 /46 |
| 16 | 1 | 1 | 0 | 1 | 0 | 0 | 0 | 0 | 17 /46 |
| 17 | 1 | 0 | 1 | 0 | 0 | 0 | 0 | 0 | 18 /46 |
| 18 | 1 | 1 | 0 | 1 | 0 | 1 | 0 | 0 | 19 /46 |
| 19 | 1 | 1 | 1 | 0 | 0 | 0 | 0 | 0 | 20 /46 |
| 20 | 1 | 0 | 1 | 1 | 0 | 0 | 0 | 0 | 21 /46 |
| 21 | 1 | 1 | 1 | 0 | 0 | 1 | 0 | 0 | 22 /46 |
| 22 | 1 | 1 | 1 | 1 | 0 | 0 | 0 | 0 | 23 /46 |
| 23 | 1 | 0 | 1 | 1 | 0 | 0 | 0 | 1 | 24 /46 |
| 24 | 1 | 1 | 1 | 1 | 0 | 1 | 0 | 0 | 25 /46 |
| 25 | 1 | 1 | 1 | 1 | 0 | 0 | 0 | 1 | 26 /46 |
| 26 | 1 | 0 | 1 | 1 | 0 | 0 | 1 | 0 | 27 /46 |
| 27 | 1 | 1 | 1 | 1 | 0 | 1 | 0 | 1 | 28 /46 |
| 28 | 1 | 1 | 1 | 1 | 0 | 0 | 1 | 0 | 29 /46 |
| 29 | 1 | 0 | 1 | 1 | 0 | 0 | 1 | 1 | 30 /46 |
| 30 | 1 | 1 | 1 | 1 | 0 | 1 | 1 | 0 | 31 /46 |
| 31 | 1 | 1 | 1 | 1 | 0 | 0 | 1 | 1 | 32 /46 |
| 32 | 1 | 0 | 1 | 1 | 1 | 0 | 0 | 0 | 33 /46 |
| 33 | 1 | 1 | 1 | 1 | 0 | 1 | 1 | 1 | 34 /46 |
| 34 | 1 | 1 | 1 | 1 | 1 | 0 | 0 | 0 | 35 /46 |
| 35 | 1 | 0 | 1 | 1 | 1 | 0 | 0 | 1 | 36 /46 |
| 36 | 1 | 1 | 1 | 1 | 1 | 1 | 0 | 0 | 37 /46 |
| 37 | 1 | 1 | 1 | 1 | 1 | 0 | 0 | 1 | 38 /46 |
| 38 | 1 | 0 | 1 | 1 | 1 | 0 | 1 | 0 | 39 /46 |
| 39 | 1 | 1 | 1 | 1 | 1 | 1 | 0 | 1 | 40 /46 |
| 40 | 1 | 1 | 1 | 1 | 1 | 0 | 1 | 0 | 41 /46 |
| 41 | 1 | 0 | 1 | 1 | 1 | 0 | 1 | 1 | 42 /46 |
| 42 | 1 | 1 | 1 | 1 | 1 | 1 | 1 | 0 | 43 /46 |
| 43 | 1 | 1 | 1 | 1 | 1 | 0 | 1 | 1 | 44 /46 |
| 44 | 1 | 1 | 1 | 1 | 1 | 1 | 1 | 1 | 46 /46 |

Fig. 22

| EXAMPLE | TIME RATIO |
|---|---|
| 1 | 4 : 3 (75%) |
| 2 | 9 : 6 (67%) |
| 3 | 6 : 4 OR 6 : 5 (67% OR 83%) |
| 4 | 13 : 9 OR 14 : 9 (69% OR 64%) |

Fig. 23

T1:T2:T3=4:3:2

| VOLTAGE LEVEL | T1 | T2 | T3 | Vrms |
|---|---|---|---|---|
| 0 | 0 | 0 | 0 | 0.91 |
| 2 | 0 | 0 | 1 | 0.93 |
| 3 | 0 | 1 | 0 | 0.94 |
| 4 | 1 | 0 | 0 | 0.95 |
| 5 | 0 | 1 | 1 | 0.96 |
| 6 | 1 | 0 | 1 | 0.97 |
| 7 | 1 | 1 | 0 | 0.98 |
| 9 | 1 | 1 | 1 | 1 |

Vrms: STANDARDIZED BASED ON ON

T1:T2:T3=5:3:2

| VOLTAGE LEVEL | T1 | T2 | T1 | T2 |
|---|---|---|---|---|
| 0 | 0 | 0 | 0 | 0 |
| 2 | 0 | 0 | 1 | 0 |
| 3 | 0 | 0 | 0 | 1 |
| 4 | 1 | 0 | 1 | 0 |
| 5 | 0 | 0 | 1 | 1 |
| 6 | 0 | 1 | 0 | 1 |
| 7 | 1 | 0 | 1 | 1 |
| 8 | 0 | 1 | 1 | 1 |
| 10 | 1 | 1 | 1 | 1 |

T1:T2=2:3

| | T1 | T2 | T3 | T1 | T2 | T3 |
|---|---|---|---|---|---|---|
| 0 | 0 | 0 | 0 | 0 | 0 | 0 |
| 2 | 0 | 0 | 0 | 0 | 0 | 1 |
| 3 | 0 | 0 | 0 | 0 | 1 | 0 |
| 4 | 0 | 0 | 1 | 0 | 0 | 1 |
| 5 | 0 | 0 | 0 | 0 | 1 | 1 |
| 6 | 0 | 0 | 0 | 1 | 0 | 0 |
| 7 | 0 | 0 | 1 | 0 | 1 | 1 |
| 8 | 0 | 0 | 0 | 1 | 0 | 1 |
| 9 | 0 | 0 | 0 | 1 | 1 | 0 |
| 10 | 0 | 0 | 1 | 1 | 0 | 1 |
| 11 | 0 | 0 | 0 | 1 | 1 | 1 |
| 12 | 0 | 1 | 0 | 1 | 1 | 0 |
| 13 | 0 | 0 | 1 | 1 | 1 | 1 |
| 14 | 0 | 1 | 0 | 1 | 1 | 1 |
| 15 | 1 | 0 | 0 | 1 | 1 | 0 |
| 16 | 0 | 1 | 1 | 1 | 1 | 1 |
| 17 | 1 | 0 | 0 | 1 | 1 | 1 |
| 18 | 1 | 1 | 0 | 1 | 1 | 0 |

| | T1 | T2 | T3 | T1 | T1 | T3 |
|---|---|---|---|---|---|---|
| 19 | 1 | 0 | 1 | 1 | 1 | 1 |
| 20 | 1 | 1 | 0 | 1 | 1 | 1 |
| 22 | 1 | 1 | 1 | 1 | 1 | 1 |

T1:T2:T3=6:3:2

Fig. 34

| (a) | (b) |
|---|---|
| 0 | 0 |
| 2 | |
| 3 | 1 |
| 4 | |
| 5 | 2 |
| 6 | |
| 7 | 3 |
| 8 | 4 |
| 9 | 5 |
| 10 | 6 |
| 11 | 7 |
| 12 | 8 |
| 13 | 9 |
| 14 | 10 |
| 15 | 11 |
| 16 | 12 |
| 17 | |
| 18 | 13 |
| 19 | |
| 20 | 14 |
| 22 | 15 |

Fig. 35

| IMAGE NUMBER | TITLE | CONTENTS |
|---|---|---|
| 1 | BIKE RACING | AN IMAGE OF A MOTOR BIKE FOR RACING WHICH IS COLORED WITH WHITE AND RED AS BASIC COLORS, THE MOTOR BIKE BEING CONTRASTED WITH A COLOR FOR THE GROUND |
| 2 | NIGHT SCENE | AN IMAGE OF THE DARKEST SCENE |
| 3 | ALPS | A SCENE OF A SNOW MOUNTAIN IN A BLUE SKY |
| 4 | AIRPLANE | AN IMAGE OF A RELATIVELY BRIGHT OBJECT |
| 5 | RAIL COASTER | AN IMAGE OF A RAIL COASTER IN A BACKGROUND OF CLOUD |
| 6 | LABORATORY | AN IMAGE OF A MAN IN A DARK ROOM |

Fig. 37

T1:T2:T3:T4=12:6:3:2

| (a) | | (b) | |
|---|---|---|---|
| 0 | 24 | 0 | 16 |
| 2 | 25 | | 17 |
| 3 | 26 | 1 | 18 |
| 4 | 27 | | 19 |
| 5 | 28 | | 20 |
| 6 | 29 | 2 | 21 |
| 7 | 30 | | 22 |
| 8 | 31 | | 23 |
| 9 | 32 | 3 | 24 |
| 10 | 33 | | 25 |
| 11 | 34 | 4 | 26 |
| 12 | 35 | | 27 |
| 13 | 36 | 5 | |
| 14 | 37 | 6 | 28 |
| 15 | 38 | 7 | |
| 16 | 39 | 8 | |
| 17 | 40 | 9 | 29 |
| 18 | 41 | 10 | |
| 19 | 42 | 11 | |
| 20 | 43 | 12 | 30 |
| 21 | 44 | 13 | |
| 22 | 46 | 14 | 31 |
| 23 | | 15 | |

Fig. 39

(TIME RATIO)

VOLTAGE LEVEL

| | 1 | 2 | 4 | 8 |
|---|---|---|---|---|
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 0 | 0 | 1 |
| 9 | 1 | 0 | 0 | 1 |
| 10 | 0 | 1 | 0 | 1 |
| 11 | 1 | 1 | 0 | 1 |
| 12 | 0 | 0 | 1 | 1 |
| 13 | 1 | 0 | 1 | 1 |
| 14 | 0 | 1 | 1 | 1 |
| 15 | 1 | 1 | 1 | 1 |

Fig.40A

| (VOLTAGE LEVEL) | | | | | (GRADATION LEVEL) | | | | |
|---|---|---|---|---|---|---|---|---|---|
| 0 | 16 | 32 | 48 | | 0 | | 18 | | |
| 1 | 17 | 33 | 49 | | | 3 | 19 | | |
| 2 | 18 | 34 | 50 | | | 4 | 20 | 30 | |
| 3 | 19 | 35 | 51 | | | 5 | 21 | | |
| 4 | 20 | 36 | 52 | | | 6 | 22 | | |
| 5 | 21 | 37 | 53 | | | 7 | 23 | | |
| 6 | 22 | 38 | 54 | | | 8 | 24 | | |
| 7 | 23 | 39 | 55 | | 1 | 9 | 25 | | |
| 8 | 24 | 40 | 56 | | | 10 | 26 | | |
| 9 | 25 | 41 | 57 | | | 11 | 27 | | |
| 10 | 26 | 42 | 58 | | | 12 | 28 | | |
| 11 | 27 | 43 | 59 | | | 13 | | | |
| 12 | 28 | 44 | 60 | | | 14 | 29 | 31 | |
| 13 | 29 | 45 | 61 | | | 15 | | | |
| 14 | 30 | 46 | 62 | | 2 | 16 | | | |
| 15 | 31 | 47 | 63 | | | 17 | | | |

Fig. 40B

| (VOLTAGE LEVEL) | | | | | (GRADATION LEVEL) | | | |
|---|---|---|---|---|---|---|---|---|
| 0 | 16 | 32 | 48 | | 0 | 6 | 16 | 27 |
| 1 | 17 | 33 | 49 | | | | 17 | |
| 2 | 18 | 34 | 50 | | | 7 | 18 | 28 |
| 3 | 19 | 35 | 51 | | | | 19 | |
| 4 | 20 | 36 | 52 | | 1 | 8 | 20 | |
| 5 | 21 | 37 | 53 | | | | 21 | 29 |
| 6 | 22 | 38 | 54 | | | 9 | 22 | |
| 7 | 23 | 39 | 55 | | 2 | | | |
| 8 | 24 | 40 | 56 | | | 10 | 23 | 30 |
| 9 | 25 | 41 | 57 | | | | | |
| 10 | 26 | 42 | 58 | | 3 | 11 | 24 | |
| 11 | 27 | 43 | 59 | | | | | |
| 12 | 28 | 44 | 60 | | 4 | 12 | 25 | 31 |
| 13 | 29 | 45 | 61 | | | 13 | | |
| 14 | 30 | 46 | 62 | | 5 | 14 | 26 | |
| 15 | 31 | 47 | 63 | | | 15 | | |

DRIVING METHOD AND DRIVING DEVICE FOR A DISPLAY DEVICE

BACKGROUND OF THE INVENTION

Field of the Invention

The present invention relates to a driving method and a driving device for a simple matrix type display device, and in particular, is related to a driving device using a driving method capable of effecting a display at a high contrast ratio in a high response type STN liquid crystal display device. Further, the present invention relates to a driving method and a driving device using a multiple line simultaneously selecting method whereby an uneven display of the liquid crystal display device can be reduced.

DISCUSSION OF BACKGROUND

A display medium is used as a man-machine interface to various articles. Among these, a liquid crystal display device having the features of reduced weight, a thin thickness and low power consumption in comparison with CTR has provided various articles such as a portable telephone, a portable information terminal, a navigation device for automobile and so on by taking the advantage of these features.

In a driving system for a liquid crystal panel to realize a dot display, there are mainly two systems: a simple (passive) matrix type which is a system for applying directly voltages stripe-like electrodes arranged to cross orthogonally to each other, and an active matrix type wherein a TFT is arranged for each pixel. Recently, STN liquid crystal display device having a large number of display pixels is used as a simple matrix type display. However, when a response speed is increased to the STN liquid crystal elements, the contrast ratio is decreased.

As the driving system for driving the STN liquid crystal elements at a higher speed, there is proposed a multiple line simultaneously selecting method (a multiple line addressing method: MLA method). In the multiple line simultaneously selecting method, a plurality of scanning electrodes (row electrodes) are selected and driven as a batch. In the multiple line simultaneously selecting method, in order to control independently a column display pattern applied to data electrodes (column electrodes), a predetermined train of voltage pulses is applied to each of the row electrodes driven simultaneously.

A voltage group of voltage pulses (selection pulse voltages) applied to respective lines of row electrode can be expressed by a matrix of L rows and K columns. Hereinbelow, the matrix is referred to as a selection matrix (A) wherein L represents a simultaneously selected number. The voltage group of voltage pulses can be represented as a group of mutually orthogonal vectors. Accordingly, a matrix including these vectors as elements forms an orthogonal matrix. Respective row vectors in each matrix are mutually orthogonal.

In the orthogonal matrix, each row corresponds to each line in the liquid crystal display device. For example, an element of the first line of the selection matrix (A) is applicable to the first line in an L number of selection lines. Namely, selection pulses are applied to the row electrodes of the first line in the order of the elements of the first column, the elements of the second column and so on.

FIGS. 1 to 3 are diagrams showing how a sequence of voltage waveforms applied to the column electrodes is determined. As an example, pixels are arranged in 8 rows and 2 columns as shown in FIG. 1 and an Hadamard's matrix of 4 rows and 4 columns is used as a selection matrix as shown in FIG. 2. In the selection matrix in FIG. 2, "1" represents a positive selection pulse and "−1" represents a negative selection pulse. Hereinbelow, simultaneously selected 4 lines are called a subgroup. In FIG. 1, SG1 indicates a subgroup 1 and SG2 indicates a subgroup 2.

A situation that display data to be displayed on column electrodes 1 and column electrodes 2 are as in FIG. 1, is assumed. In FIG. 1, a white circle means operation and a black circle means non-operation. Then, the column display patterns of the subgroup 1 and the subgroup 2 are represented by vectors (d) as shown in FIG. 3 wherein "−1" corresponds to a ON display and "1" corresponds to an OFF display.

Voltage levels to be applied sequentially to the subgroup 1 and the subgroup 2 of the column electrodes 1, 2 are as shown in vectors (v) in FIG. 3. Each vector corresponds to the sum of values obtained by the product of bits between the column display pattern (an image display pattern) and the row selection pattern corresponding thereto.

FIG. 4 is a timing diagram showing the voltage waveforms of the column electrodes 1 and 2 corresponding to the vectors (v) shown in FIG. 3. In FIG. 4, the ordinate represents a voltage applied to the column electrodes and the abscissa represents a time. Symbols sg1 and sg2 represent selection periods of the subgroup 1 and the subgroup 2 , sf1 to sf4 represent periods of the subframe 1 to the subframe 4 respectively. In the selection matrix consisting of L rows and 4 columns, 4 subframe periods in the subframe 1 to the subframe 4 form 1 frame.

According to such MLA method, it is possible to control the frame response of liquid crystal and achieve a high response (r+d<200 ms wherein r represents a rising time of liquid crystal molecules and d represents a falling time) as well as a high contrast ratio (40:1 or more). Namely, a picture image of high quality can be provided, which was deemed to be difficult in a conventional driving method for a simple matrix type display device such as STN type.

In recent years, an improvement of a liquid crystal material or study for a gradation method for the simple matrix type liquid crystal display device has been made, and it has been estimated that a display of picture images having nearly natural colors is obtainable even by using the simple matrix system by improving the contrast and the number of colors. Further, the contrast or the number of colors would be improved even by the above-mentioned MLA method.

Description will be made as several gradation methods by using the simple matrix system.

(1) Frame Thinning (Frame Modulation)

In this system, the shortest period in which voltage levels corresponding to ON or OFF are applied to all pixels for display is determined as a frame, a plurality of frames are formed as one unit, and a pattern consisting of ON and OFF is applied periodically and repeatedly whereby intermediate tones are presented. The number of gradation levels can be increased by increasing the number of frames in one unit. However, when the number of frames is increased, the cycle of one unit becomes long. Accordingly, the response of liquid crystal in repeated ON and OFF operations is recognized as a flicker to an observer.

(2) Pulse Width Modulation

In this method, a period in which lines of row are once selected is divided into a plurality of time regions and a voltage level corresponding to ON and a voltage level corresponding to OFF are assigned to these time regions. Intermediate tones can be displayed in response to a combination of ON and OFF. The intermediate tones can be increased depending on the number of time regions. However, when the number of gradation levels is increased, the number of change of applicable voltages per unit time is increased. In this case, a distortion of a voltage waveform takes place in the position at which an applied voltage is changed. A distortion of voltage waveform causes a loss in an effective value of the applied voltage, and a phenomenon of cross-talking is resulted.

(3) Amplitude Modulation

In the simple matrix system, when voltage pulses are applied to lines of row, predetermined voltages are applied also to the column electrodes at crossing positions in synchronism therewith. When a gradation display is not effected, a voltage level corresponding to ON is applied in an ON time, and a voltage level corresponding to OFF is applied in an OFF time. In the amplitude modulation, intermediate voltages between ON and OFF are applied to produce intermediate tones. In the amplitude modulation, it is necessary to add a correction voltage to a column voltage in order to satisfy a voltage averaging method. Therefore, the number of output levels from the column drivers is increased. Accordingly, an increase of gradation levels invites increases of intermediate voltage levels and correction voltage levels.

When the amplitude modulation is used together with MLA method, more voltage levels are required, and the number of output levels from the column drivers is increased, which increases cost. As an example that the gradation display method is applied to MLA method, there are methods disclosed in JP-A-5-100642 and JP-A-7-199863.

As described above, an attempt of increasing the number of gradation levels in either method causes deterioration of a display or a cost increase. Accordingly, the conventional method could not provide gradation levels exceeding 8–16 gradation levels.

In the following, description will be made as to a driving method in which a gradation method using PWM (pulse width modulation) system is applied to the multiple line simultaneously selecting method.

FIG. 5 is a diagram showing an example that a display of 7 gradation levels is conducted in a period consisting of 2 frames by using the PWM system. In FIG. 5, a selection period means a period for selecting subgroups, i.e., sg1 or sg2.

The selection period in each subgroup is divided into two portions and the ratio of T1, T0, which shows lengths of divided periods, is 2:1. When 7 gradation levels are expressed by the gradation levels of 0/6–6/6, the relation of each of the gradation levels to ON/OFF in the respective periods of T1, T0 in the first and second frames is as in FIG. 5 wherein "1" corresponds to an ON display and "0" corresponds to an OFF display.

In the example shown in FIG. 5, the gradation level 0/6 at the lowest position shows an OFF display in both the periods of T1, T0 of the 2 frames, and the gradation level 6/6 at the highest position shows an ON display in both the periods of T1, T0 of the two frames. Intermediate gradation levels show ON displays and OFF displays in the periods of T1, T0 of the two frames.

Voltages applied to column electrodes in this case will be described. For example, when gradation levels to be displayed on 4 lines L1, L2, L3, L4 of a certain subgroup selected simultaneously, are 3/6, 2/6, 1/6 and 0/6, ON/OFF displays in the periods T1, T0 in a selection period in the first frame are [1,1] on L1, [1,0] on L2, [0,1] on L3 and [0,0] on L4 as shown in FIG. 6.

Then, voltage levels applied to column electrodes in the periods T1, T0 are obtained by using the Hadamard's matrix of 4 rows and 4 columns shown in FIG. 2. Then, voltage waveforms for the subframe 1 to the subframe 4 as shown in FIG. 7 are obtained. Namely, there are changes of voltage levels at the points of changing from the period T1 to the period T0 in the subframe 2 and the subframe 3.

In FIG. 3, "−1" is made correspondent to an ON display and "1" is made correspondent to an OFF display. However, in the following description, an ON display is expressed by "1" and an OFF display is expressed by "0" in order to facilitate understanding. This definition is also applicable to the example shown in FIG. 7. Accordingly, each of the voltage levels shown in FIG. 7 corresponds to the sum of the products of bits in a bit-to-bit relation between each column in the matrix shown in FIG. 2 and values shown in FIG. 6 wherein "0" reads "1" (an OFF display) and "1" reads "−1" (an ON display).

At each point of change of the applied voltages, a distortion of waveform is resulted as indicated in FIG. 7. Since the distortion of waveform creates a loss in an effective value of the applied voltages, there causes a problem that a so-called "an uneven display", i.e., a difference of brightness, is increased in a displayed picture. Further, in the multiple line simultaneously selecting method, a degree of change in the voltage levels, i.e., a change of voltage from "−4" to "0" or "±2", is large. Accordingly, there is a problem that a distortion of waveform becomes large with the change of the voltage levels.

In order to increase the number of gradation levels which can be displayed with two frames, it is considered that the selection periods are divided into three portions as shown in FIG. 8 which shows an example that the ratio of the length of three-divided periods T2, T1, T0 is 4:2:1. In this case, there are changes of voltage waveform twice at the switching times between T2 and T1 and T1 and T0. Accordingly, a distortion of the waveform of an applied voltage further increases an uneven display.

Further, when the number of simultaneously selected lines is L, the number of voltage levels applied to column electrodes is L+1. For example, when the Hadamard's matrix of 4 rows and 4 columns shown in FIG. 2 is used as a selection matrix, the number of applicable voltage levels is 5 since the number of simultaneously selected lines is 4. Specifically, 5 kinds of levels (−4, −2, 0, 2, 4) are applied to column electrodes i, j, as shown in FIG. 4.

On the other hand, in the liquid crystal display device for which the ordinary driving method (the line successive driving method) is used, the number of voltage levels applied to column voltages is 2 levels in APT driving, and 4 levels in IAPT driving. If the above-mentioned method of selecting simultaneously 4 lines is used, the number of voltage levels is increased to 5 levels. An increase of applicable voltage levels creates a problem that cost for column electrode drivers is increase.

With respect to this problem, there has been proposed a method of reducing the number of voltage levels applied to column voltages in a multiple line simultaneously selecting method. For example, an imaginary row, which is not actually displayed, is provided in a part of simultaneously selected lines to thereby reduce the number of voltage levels.

FIGS. 9A and 9B are diagrams showing an example that in an Hadamard's matrix of 4 rows and 4 columns, the fourth line is an imaginary row. FIG. 9A shows a selection matrix and display data, and FIG. 9B shows image display patterns and voltage patterns as examples. When display data of row electrodes L=1, L=2 and L=3 and imaginary row data corresponding thereto with respect to column electrodes i, j are arranged as shown in FIG. 9A, column display patterns are shown by vectors (d) as shown in FIG. 9B.

Each of the voltage patterns to be applied sequentially to the column electrodes i, j corresponds to the sum of values obtained by taking the product of bits of the column display pattern and the row selection pattern corresponding thereto. Accordingly, the voltage patterns applied sequentially to the column electrodes i, j are according to the vectors (v) as shown in FIG. 9B. In this case, the number of levels of the voltage patterns to be applied is reduced to 2 levels.

Next, description will be made as to a driving method in a case that a gradation method using PWM (pulse width modulation) system is applied to the multiple line simultaneously selecting method in which an imaginary row is provided to reduce the number of levels. First, a generally used PWM gradation system is shown in FIG. 10 wherein "−1" represents an ON display and "1" represents an OFF display.

As shown in FIG. 10, a selection period is divided uniformly into 4 portions T1–T4. A gradation level 4/4 effects an ON display in the divided periods of T1–T4, and a gradation level 0/4 effects an OFF display in the divided periods of T1–T4. Gradation levels 1/4, 2/4 and 3/4 effect gradation displays of intermediate levels by mixing the periods of an ON display and OFF display. Thus, a gradation display of 5 levels can be effected by the technique of 4-division.

As the conventional example applying the PWM gradation method in the multiple line simultaneously selecting method, there are methods as disclosed in JP-A-5-100642 and JP-A-7-199863. Further, a technique that an imaginary row is used in the multiple line simultaneously selecting method is disclosed in JP-A-6-4049, EP0522510A1, U.S. Pat. No. 5,262,881 and so on. Further, as the conventional example using the PWM gradation method in the multiple line simultaneously selecting method in which an imaginary row is provided, there is a method as disclosed in JP-A-10-301545.

In the following, the example that the PWM gradation method is applied to the multiple line simultaneously selecting method in which an imaginary row is provided is described with reference to FIGS. 11A–11C. FIG. 11A shows an example of an ON-OFF display in divided periods and FIG. 11B shows an example of voltage patterns applied to column electrodes. As shown in FIG. 11A, when display data on simultaneously selected lines L1, L2, L3 are 3/4, 2/4 and 1/4, displays of ON ("−1") and OFF ("1") in the selected periods T1–T4 are [1,−1,−1,−1] on L1, [1,1,−1,−1] on L2 and [1,1,1,−1] on L3.

Data on the imaginary row are determined for each of the periods T1–T4 in order to render the number of levels of applicable voltages to be 2 levels. In a case of using the Hadamard's matrix of 4 rows and 4 columns as shown in FIG. 2, the display data on L1, L2 and L3 are (1,1,1) in the period T1, and therefore, the imaginary data show "−1". Similarly, since the display data on T2 are (−1,1,1), the imaginary data show "1". Since the display data on T3 are (−1,−1,1), the imaginary data show "−1" Since the display data on T4 are (−1,−1,−1), the imaginary data show "1".

When the product is taken to corresponding bit between the column display pattern shown in FIG. 11A and the row selection pattern shown in FIG. 9A, which corresponds to the column display pattern, and the values obtained by the calculations are added together, the voltage patterns applied to column electrodes in each of the first to fourth selection periods are as shown in FIG. 11B. The driving method in which the gradation method by the PWM system is applied to the multiple line simultaneously selecting method wherein an imaginary row is provided to reduce the number of levels, is conducted according to the above-mentioned processes.

However, when a liquid crystal display device is driven by the above-mentioned method, there is a problem that a difference of brightness is caused in a displayed image, i.e., an uneven display is increased. Such problem is described with reference to FIG. 11C. FIG. 11C shows waveforms of applied voltages in cases of the first selection and the second selection. As shown in FIG. 11C, a change point of voltage level occurs once in the first selection and three times in the second selection. In these change points, the waveforms of applied voltage are dull as indicated by dotted lines. Such dull waveform causes a loss in the effective value of an applied voltage, and an uneven display.

As descried above, there was the problem that in the liquid crystal display device applied with the gradation displaying method by the PWM system in the multiple line simultaneously selecting method, when the number of division is increased in a selection period in order to increase the number of gradation levels, the number of change point of voltage levels applied to column electrodes is increased, with the result that an uneven display which is derived from a distortion of the waveform of the applied voltage is increased.

Further, in the case that a liquid crystal display device is driven by using the driving method to which the gradation method by the PWM system is applied to the multiple line simultaneously selecting method wherein an imaginary row is provided to reduce the number of levels, the change point of voltage levels applied to the column electrodes is increased, with the result that an uneven display is increased due to the loss of the effective value of the applied voltages which is resulted by a distortion of the waveform of the applied voltages.

Further, in a case of displaying display data based on image signals in a liquid crystal display device, there is a problem that a display is too dark or too bright depending on images to be displayed. In such a case, a user can adjust the voltage applied to the liquid crystal panel to regulate the brightness so as to be comfortable. However, such voltage adjustment is difficult to be conducted to an automobile navigation device during driving. Further, operations of voltage adjustment are troublesome even in a usual electrical article.

An active matrix system is proposed to cope with such problem, wherein a large number of levels of brightness to be displayed are provided. In such system, a correction circuit is built in so that the same assignment as a brightness distribution in CRT can be selected, for example. The correction circuit can realize the same function of assigning brightness levels as the brightness distribution in CRT whereby the brightness adjustment by a user becomes unnecessary.

However, it is difficult to produce a large number of brightness levels even by the above-mentioned gradation systems in a simple matrix type liquid crystal display device. Accordingly, it is difficult to eliminate the brightness adjustment by a user even when the correction circuit employable in the active matrix system is provided. Further, in a STN liquid crystal element, a change of brightness with a change of voltage may be further larger than that of a TFT liquid crystal element. Accordingly, a further large number of gradation levels is required in order to obtain the same brightness distribution.

SUMMARY OF THE INVENTION

It is an object of the present invention to provide a driving method or a driving device for a liquid crystal display device, which provides a display of high quality by increasing the number of gradation levels while an uneven display is controlled.

It is another object of the present invention to provide a gradation producing method or a driving device for a liquid crystal display device, which can display various kinds of images having an excellent quality without adjusting brightness levels.

In an aspect of the present invention, the selection period of either one frame in two continuous display frames is divided into two portions wherein two-divided periods are expressed by T0 and T1 and the selection period of the other frame is expressed by T2. The periods T2, T1, T0 are changed without making them to be the same, and the number of gradation levels is increased by applying a pulse width modulation method. Further, when the selection periods of both the frames in two continuous display frames are divided respectively into two portions wherein divided periods are expressed by T3, T2, T0, T1, and they are changed without making them to be the same, the number of gradation levels can be increased by applying the pulse width modulation method. T2, T0, T1 or T3, T2, T0, T1 may be determined so as to have a predetermined time ratio. In this case, an excellent gradation display can be obtained with use of the pulse width modulation by providing such formation that the time ratio of a display frame to the other is determined to have a figure selected from a range of 50 to 90%.

According to the present invention, there is provided a driving method for a display device comprising selecting simultaneously a plurality of lines of row electrode in a liquid crystal display device comprising a plurality of row electrodes and a plurality of column electrodes and applying predetermined voltages to the selected lines of row electrode during a selection period, wherein in two continuous display frames, the time ratio of a display frame to the other is determined to have a figure selected from a range of 50 to 90%. Further, the selection period of at least one of the two display frames may be divided into two portions, and on-data and off-data are mixed in each of the divided periods in a combination of at least one in the two display frames to effect a gradation display by pulse width modulation.

In the above-mentioned driving method for a display device, the time ratio between the two continuously display frames to be displayed is 4:3 and the selection period of a shorter frame is divided to have a time ratio of 2:1. According to this method, there is no increase of a distortion of the waveform of voltage levels applied to column electrodes in a display of 8 gradation levels. As a result, a display in which an uneven display is controlled can be realized.

Further, the driving method for a display device may be such that the time ratio between the two continuous display frames to be displayed is 9:6; the selection period of a longer frame is divided to have a time ratio of 8:1, and the selection period of a shorter frame is divided to have a time ratio of 4:2. According to this method, there is no increase of a distortion of the waveform of voltage levels applied to column electrodes in a display of 16 gradation levels, with the result that a display in which an uneven display is controlled, can be realized.

The driving method for a display device of the present invention may be in particular such that on-data and off-data are mixed in each of the divided periods in two sets of combination of the two display frames to effect a gradation display by pulse width modulation. According to this method, there is no increase of a distortion of the waveform of voltage levels applied to column electrodes, with the result that a multi-gradation display of more than 16 gradation levels can be realized while an uneven display can be controlled.

According to the present invention, there is provided a driving device for a liquid crystal display device comprising a plurality of row electrodes and a plurality of column electrodes adapted to select simultaneously a plurality of lines of row electrode and to apply predetermined voltages to the selected lines of row electrode during a selection period, wherein the driving device includes a driving means which comprises a timing control means which forms a combination of at least one of two continuous display frames in which the time ratio of a display frame period to the other is within 50–90%, and which provides a timing signal so that a selection period of at least one of the two continuous display frames is divided to produce an n (n: an integer of at least three) number of divided periods, the timing signal being supplied to column drivers for driving column electrodes, a gradation processing means for producing n-bit gradation data based on inputted image data to write the n-bit gradation data in frame memories, and a column data producing means for producing column data by reading sequentially the n-bit gradation data which are stored in the frame memories in the respective divided periods and supplying the produced data to the column drivers.

The n number of divided periods include a period produced by dividing the selection period and the selection period itself.

Further, the driving device may be so constructed that the timing control means produces the timing signal so that the total time of the two continuously displayed display frames is equal to a time of an input frame to which image data are inputted.

With such construction, the writing of data into frame memories and the reading of data from the frame memories can be conducted simultaneously whereby a capacity of memories can be reduced.

Further, the driving method for a display device of the present invention may be modified so that an imaginary row is formed in addition to the lines of row electrode; a selection period is divided into a plurality of divided periods; a voltage pattern is changed so as to reduce a change point of voltage level applied to column electrodes in the one selection period, and a gradation display is effected by applying voltages to column electrodes according to the changed voltage pattern.

Further, the driving method for a display device according to the present invention may be modified so that an imaginary row is formed in addition to the lines of row electrode in a multiple line simultaneously selecting method for effecting a gradation display; a selection period is divided uniformly into a plurality of divided periods; a voltage pattern to be applied to column electrodes is determined, and a gradation display is effected by applying voltages to column electrodes with use of a voltage pattern in which there is a single change point of voltage level to be applied to the column electrodes in one selection period.

The driving device for a display device according to another aspect of the present invention is so constructed that the driving means comprises a gradation processing means for producing gradation data based on inputted image data to write the gradation data in frame memories, and a column data producing means for determining a voltage pattern to be applied to column electrodes in each period which is formed by dividing uniformly a selection period whereby control is made so that when there are a plurality of change points of voltage level to be applied to the column electrodes in a selection period, only one change point is provided.

Further, the driving method for a display device of the present invention is such that in a plurality of continuous display frames, a time of at least one frame period is made different from that of other frame period; the selection period of at least one frame in the plurality of display frames is divided into divided selection periods; on-data and off-data are provided in the selection period of the non-divided frame period and the divided selection periods to generate a plurality of voltage levels, and the plurality of voltage levels are used for display except for the voltage levels in the vicinity of the highest level and the lowest level.

The driving method described above may be such that among the plurality of voltage levels, voltage levels in the vicinity of the highest level and the lowest level are used relatively rare and voltage levels in an intermediate region are used relatively often.

For the driving method of the present invention, it is preferable that in producing an m number of intermediate voltages between A and B where A represents the highest voltage level and B represents the lowest voltage level among the plurality of voltage levels, the number of gradation levels q selected from a range of not less than L and less than U given by Formulas (1) and (2) satisfies the relation of Formula (3):

$$L=(A-B)\times 0.25+B \quad (1)$$

$$U=(A-B)\times 0.75+B \quad (2)$$

$$0.55<q/m<0.75 \quad (3)$$

The driving method is used for driving a liquid crystal display device wherein a multiple line simultaneously selecting method is used.

According to another aspect of the present invention, there is provided a driving device for a liquid crystal display device adapted to select a plurality of lines of row electrode as a batch, and to apply predetermined voltages to selected row electrodes in a selection period in the liquid crystal display device having row electrodes and column electrodes arranged in a matrix form, wherein a driving means comprises a timing control means which provides timing signals to column drivers for driving column electrodes so that the frame period of at least one frame in a plurality of continuous display frames is made different from that of other frame, and the selection period of at least one frame in the plurality of display frames is divided to form divided selection periods, a gradation processing means including a circuit for producing gradation data based on inputted image data to writes the gradation data in frame memories, wherein the gradation data are such that the number of gradation levels q selected from a range of not less than L and less than U given by the above-mentioned Formulas (1) and (2) satisfies the relation of the above-mentioned Formula (3) in producing an m number of intermediate voltages between A and B where A represents the highest voltage level and B represents the lowest voltage level among the plurality of voltage levels, and a column data producing means which produces column data by reading sequentially gradation data stored in the frame memories in the selection period of a frame in the plurality of frames and the selection period of a subframe, the produced column data being supplied to the column drivers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein;

FIG. 3 is a diagram showing an example of data on column electrodes;

FIG. 5 is a diagram showing a reference example which displays 7 gradation levels in 2 frame periods by using PWM system;

FIG. 6 is a diagram showing an example of gradation data;

FIG. 15 is a diagram showing Example 2 for conducting a display of 16 gradation levels in a period of 2 frame;

FIG. 18 is a diagram showing another gradation data in Example 3;

FIG. 21 is a diagram showing gradation data in Example 4;

FIG. 22 is a diagram showing another gradation data in Example 4;

FIG. 23 is a diagram showing time ratios in Example 1 to Example 4;

FIG. 34 is a diagram showing ON/OFF states in selection periods T1, T2 in Example 6;

FIG. 35 is a diagram for explaining a method for selecting 16 gradation levels from 21 gradation levels;

FIG. 37 is a diagram showing 6 patterns used in Example 6 and Comparative Example 3;

FIG. 39 is a diagram for explaining a method for selecting 32 gradation levels from 46 gradation levels;

FIG. 40A is a diagram showing ON/OFF states in divided periods in Comparative Example 4;

FIG. 40B is a diagram showing gradation levels in divided periods in Comparative Example 4.

DETAILED DESCRIPTION OF PREFERRED EMBODIMENTS

Figure 12:
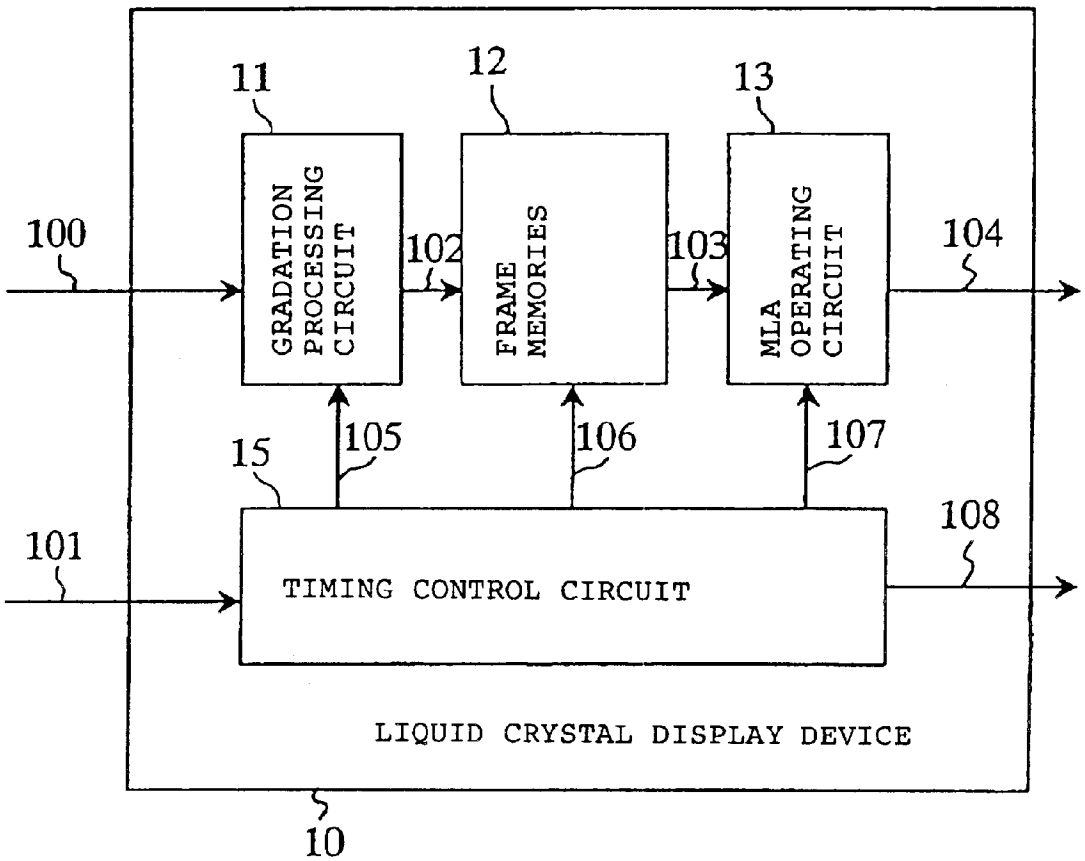
FIG. 12 is a block diagram showing an embodiment of the liquid crystal driving device according to the present invention.

FIG. 12 is a block diagram showing an embodiment of the liquid crystal driving device of the present invention in which multiplex line simultaneously selection driving is conducted.

A liquid crystal driving device 10 shown in FIG. 12 is adapted to receive image data 100 and control signals 101; to output column data signals 104 to column drivers, and to output control signals 108 to column drivers and row drivers. The control signals 101 include dot clock signals, vertical synchronizing signals, horizontal synchronizing signals, data-enabling signals showing an effective term of image data and so on.

Figures 1, 2:
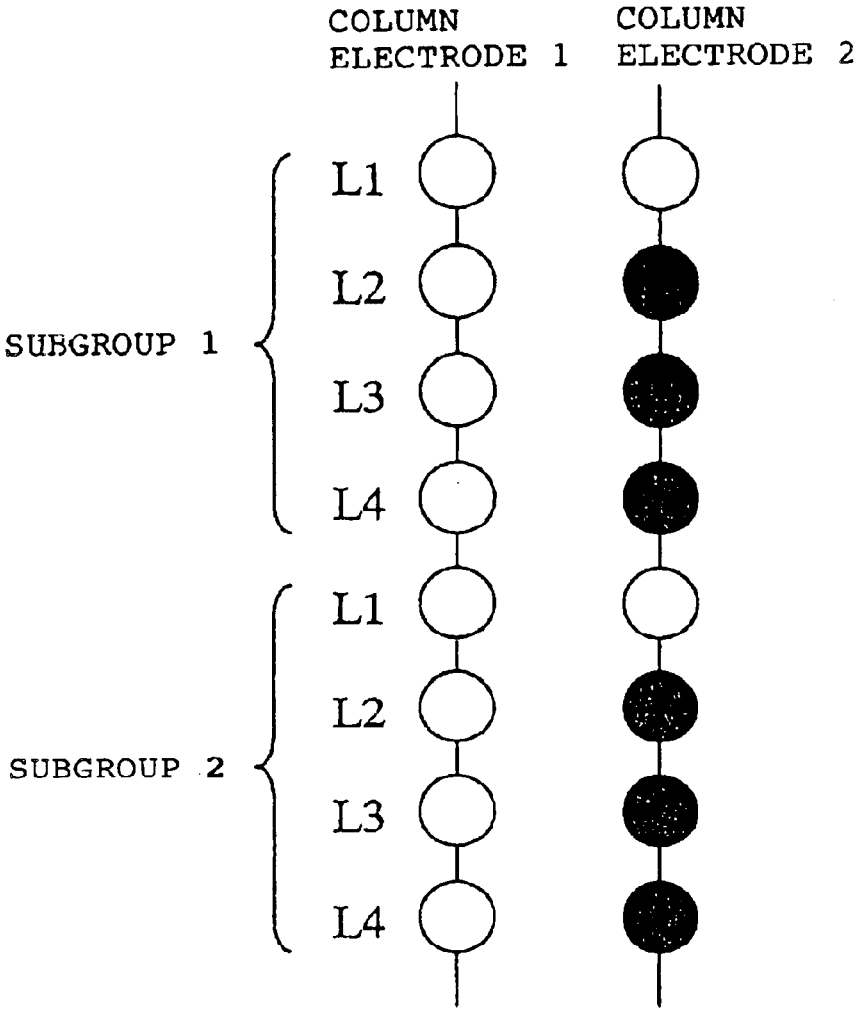
FIG. 1 is a diagram showing an example of a pixel arrangement comprising 8 rows and 2 columns.
FIG. 2 is a diagram showing an Hadamard's matrix of 4 rows and 4 columns.
Figure 4:
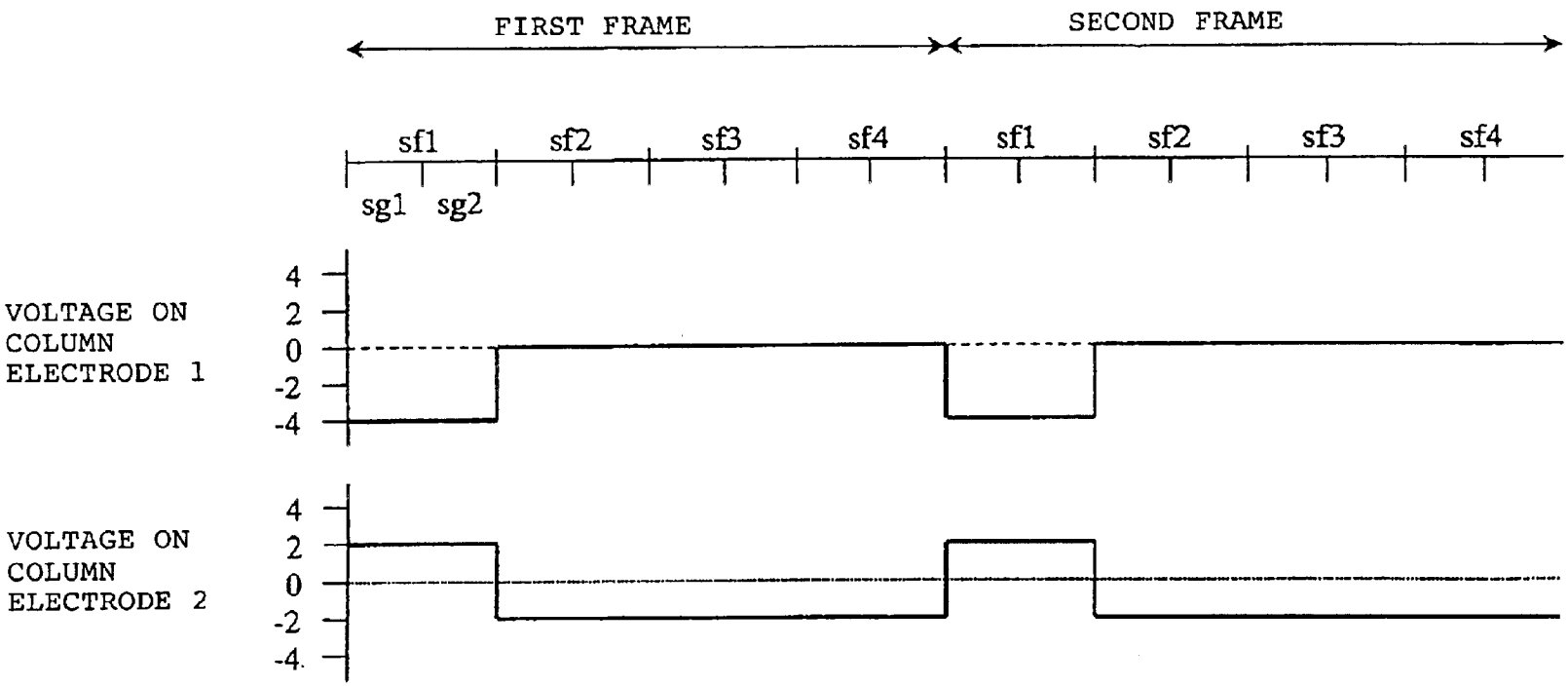
FIG. 4 is a timing diagram showing an example of the waveforms of voltages to column electrodes.
Figure 7:
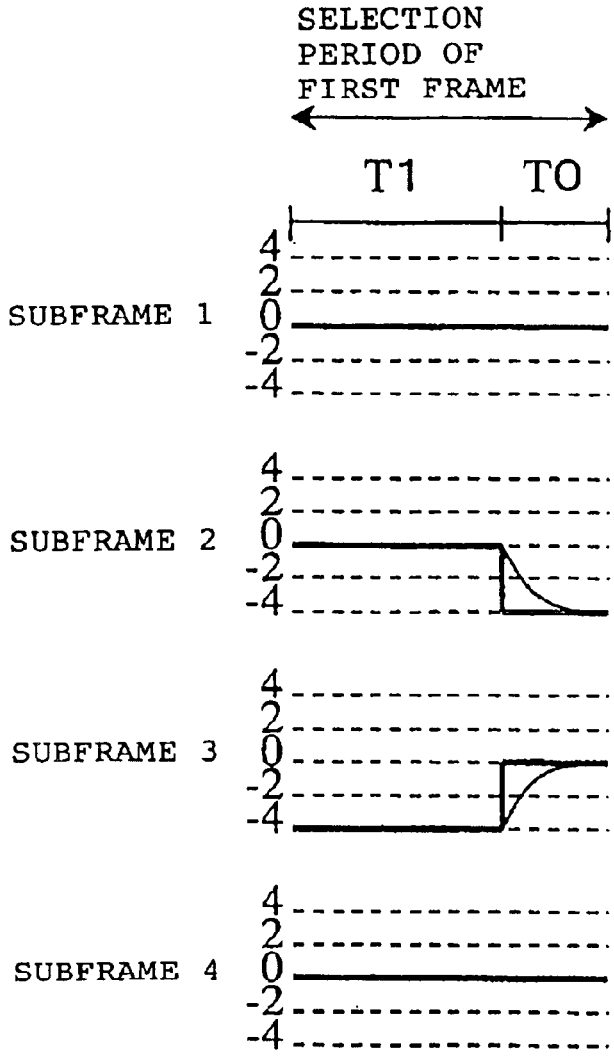
FIG. 7 is a diagram showing an example of voltage levels applied to column electrodes.
Figure 8:
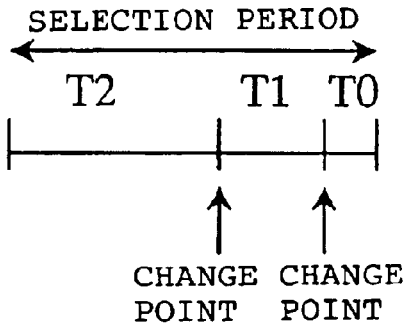
FIG. 8 is a diagram showing how to divide a selection period.

The liquid crystal driving device 10 is also provided with a row selection pattern generator, although it is omitted from FIG. 12, which supplies to the row drivers row selection pattern signals prepared based on the orthogonal matrix as shown in FIG. 2.

The image data 100 with gradation signals, which have been inputted to the liquid crystal driving device 10, are inputted to a gradation processing circuit 11. The gradation processing circuit 11 converts the received image data 100 into gradation data 102 indicating gradation levels for each display frame and writes the gradation data in frame memories 12. The frame memories 12 hold the written gradation data until the data are read several times for conducting the multiplex line simultaneously selection driving (MLA driving).

A MLA operating circuit 13 reads the gradation data 103 from the frame memories 12 to produce voltage patterns to be applied to column electrodes by conducting operations for selecting simultaneously multiple lines as shown in FIG. 3. Then, the voltage patterns are outputted to the column drivers, as the column data signals 104. Further, the row selection pattern signals from the row selection pattern generator are outputted to the row drivers. A timing control circuit 15 produces control signals 105, 106, 107 needed to each circuit block and control signals 108 to the column drivers and the row drivers.

The column drivers apply voltages for driving liquid crystal to the column electrodes of the liquid crystal panel in response to the column data signals 104. The row drivers apply predetermined voltages to the row electrodes of the liquid crystal panel in response to the row selection pattern signals.

EXAMPLE 1

Figure 13:
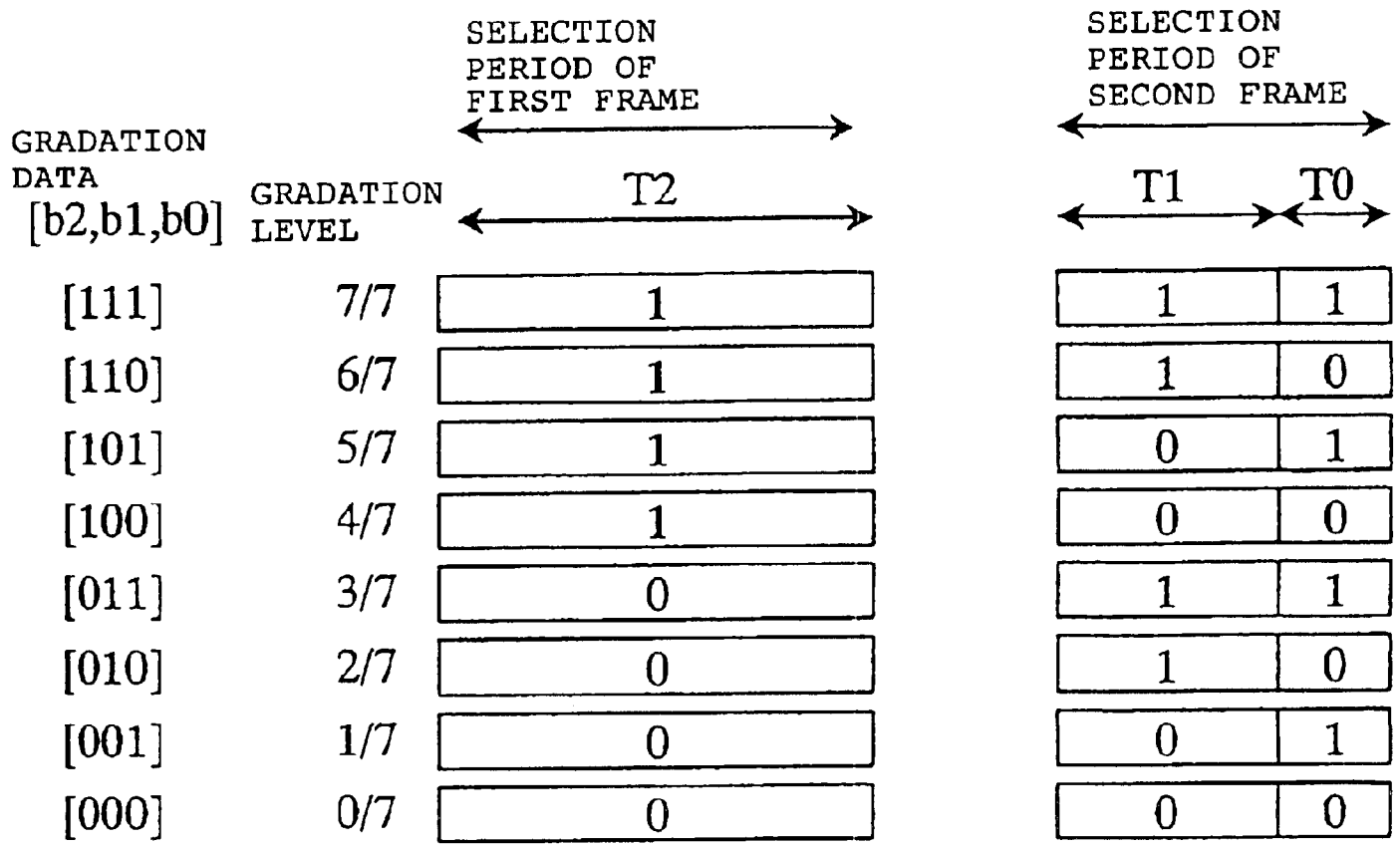
FIG. 13 is a diagram showing Example 1 for conducting a display of 8 gradation levels in a period of 2 frames.

FIG. 13 is a diagram showing Example 1 for effecting a display of 8 gradation levels in a period of 2 frames. In Example 1, the selection period in the first frame is T2 and the selection period in the second frame is divided into periods T1 and T0, and the time ratio of T2, T1 and T0 is determined to be 4:2:1. Accordingly, the length of the selection period of the first frame is different from the length of the selection period of the second frame. It is noted that in this Example, the division of period is made to only one frame.

When 8 gradation levels are expressed by FIGS. 0/7–7/7, the relation of ON/OFF of the periods T1, T2, T0 of the first and second frames to the gradation levels is as shown in FIG. 13 wherein "1" corresponds to an ON display and "0" corresponds to an OFF display. At the lowest gradation level 0/7, an OFF display appears in the periods T2, T1 and T0, and at the highest gradation level 7/7, an ON display appears in the periods T2, T1 and T0. At intermediate gradation levels, an ON display and an OFF display appear in the periods T1, T2 and T0 as shown in FIG. 13.

In FIG. 13, the division of period is not made in the selection period of the first frame and the division of period is made only in the selection period of the second frame. Accordingly, a change of voltage level applicable in the selection periods of the first and second frames occurs only at the change point between T1, T0 in the second frame. Therefore, a possibility of a distortion of the waveform of applied voltage is small because of the least change point whereby occurrence of an uneven display is reduced.

The gradation processing circuit 11 in the liquid crystal driving device 10 produces 3-bit gradation data [b2, b1, b0] based on image data 100 inputted with gradation signals, the gradation data being written in the frame memories 12. In the relation of the gradation data to the gradation levels, [b2, b1, b0]=[000] indicates the gradation level 0/7 and [b2, b1, b0]=[111] indicates the gradation level 7/7 as shown in FIG. 13.

In order to obtain the change of the gradation levels as in FIG. 13, the MLA operating circuit 13 reads b2 in the period of the first frame, b1 in the period of T1 in the second frame and b0 in the period of T0 in the second frame, based on the gradation data [b2, b1, b0] stored in the frame memories 12 so that column data signals 104 ([c2, c1, c0]) to be outputted to the column drivers are produced. The timing control circuit 15 controls latch signals to be supplied to the column drivers so that the time ratio of the first frame to the second frame is 4:3 and the time ratio as a result of dividing the selection period of the second frame is 2:1.

Figure 14:
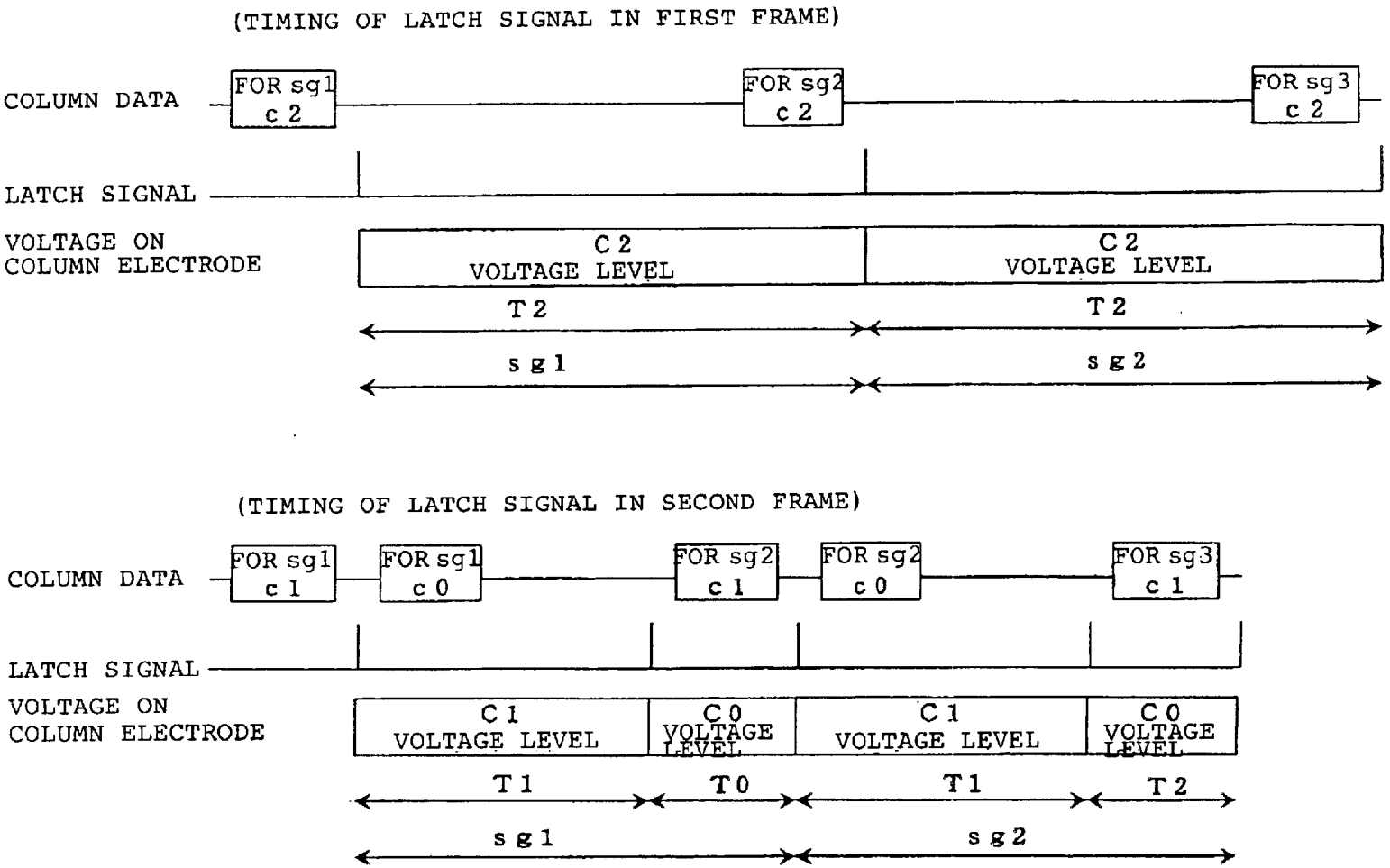
FIG. 14 is a diagram showing timings of latch signals outputted from a timing controlling circuit.

FIG. 14 is a timing diagram showing the timing of the latch signals outputted from the timing control circuit 15. With respect to the first frame, the timing control circuit 15 outputs a latch signal by which data are taken by the column drivers, when column data signals (column data) c2 for the first subgroup (sg1) are outputted from the MLA operating circuit 13 to the column drivers. Upon receiving the latch signal, the column drivers apply to the column electrodes voltages corresponding to the inputted data to thereby drive the liquid crystal.

Similarly, column data c2 for the second subgroup (sg2) are outputted from the MLA operating circuit 13 to the column drivers, and the timing control circuit 15 outputs a latch signal to the column drivers. Then, predetermined voltages are applied to the column electrodes. Accordingly, a period between the present latch signal and the next latch signal indicates the selection period T2 of the first subgroup.

In the second frame, column data c1 for the first subgroup (sg1) are outputted from the MLA operating circuit 13 to the column drivers, and a latch signal is outputted from the timing control circuit 15 to the column drivers. Then, predetermined voltages are applied to the column electrodes. Then, column data c0 are outputted from the MLA operating circuit 13 to the column drivers and a latch signal is outputted from the timing control circuit 15 to the column drivers whereby predetermined voltages are applied to the column electrodes. Then, voltages are applied to the column electrodes in the same manner as described above.

FIG. 14 shows that the period of each latch signal corresponds to the period T1 and the period T0. Thus, the timing control circuit 15 controls the periods T2, T1 and T0 to have the time ratio of 4:2:1 by adjusting the output timing of the latch signal.

EXAMPLE 2

FIG. 15 is a diagram showing Example 2 for effecting a display of 16 gradation levels in a period of 2 frames. In Example 2, the selection period of the first frame is divided into T3 and T0, and the selection period of the second frame is divided into T2 and T1. The time ratio of T3, T2, T1 and T0 is 8:4:2:1. When 16 gradation levels are expressed by gradation levels 0/15–15/15, the relation of ON/OFF of the periods T3, T2, T1, T0 of the first and second frames to the gradation levels is as shown in FIG. 15.

Accordingly, the length of the selection period of the first frame is different from the length of the selection period of the second frame. It is noted that in this Example, the division of period is made to both the frames. In this case, also, "1" corresponds to an ON display and "0" corresponds to an OFF display.

At the lowest gradation level 0/15, an OFF display appears in the periods T3, T2, T1 and T0, and at the highest gradation level 15/15, an ON display appears in the periods T3, T2, T1 and T0. At intermediate gradation levels, an ON display and an OFF display appear in the periods T3, T2, T1 and T0 as shown in FIG. 15.

In the case of conducting the division as described above, a change point of voltage level applicable in each of the selection periods occurs at two points: a change point between T3 and T0 in the first frame and a change point between T2 and T1 in the second frame. Namely, the change takes place once in a selection period in the same manner as the conventional case. Accordingly, in this Example, the number of gradation levels can be increased although a degree of an uneven display due to a distortion of the waveform of voltage is substantially the same as that of the conventional Example.

The gradation processing circuit 11 in the liquid crystal driving device 10 produces 4-bit gradation data [b4, b2, b1, b0] based on image data 100 inputted with gradation signals, and the produced gradation data are written in the frame memories 12. In the relation of the gradation data to the gradation levels, [b3, b2, b1, b0]=[0000] indicates the gradation level 0/15 and [b3, b2, b1, b0]=[1111] indicates the gradation 15/15.

In this Example, the timing control circuit 15 controls in such a manner that the time ratio of the first frame to the second frame is 9:6; the time ratio as a result of dividing the selection period of the first frame is 8:1, and the time ratio as a result of dividing the selection period of the second frame is 4:2. The MLA operating circuit 13 reads b3 in the period T3 and b0 in the period T0 in the first frame, and b2 in the period T2 and b1 in the period T1 in the second frame respectively, based on the gradation data [b3, b2, b1, b0] stored in the frame memories 12 so that column data signals to be outputted to the column drivers are produced. The timing control circuit 15 controls the periods T3, T2, T1 and T0 to have a time ratio of 8:4:2:1 by adjusting the output timing of the latch signals.

EXAMPLE 3

Figures 16, 17:
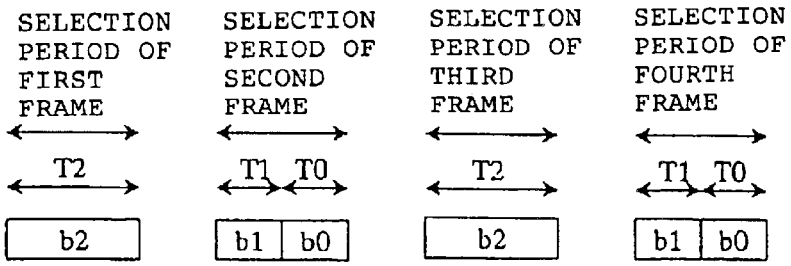
FIG. 16 is a diagram showing how to divide a selection period in Example 3.
FIG. 17 is a diagram showing gradation data in Example 3.

In the following, description will be made as to a system of increasing further the number of gradation levels by increasing the number of frames to 4 frames to thereby realize a gradation display. In particular, a case of conducting a display of 21 gradation levels with 4 frames is explained. As shown in FIG. 16, the selection period of the first frame and the selection period of the third frame are respectively defined as T2 and the selection period of the second frame and the selection period of the fourth frame are respectively divided into T1 and T0 so that the time ratio of T2, T1 and T0 is 6:3:1 or 6:3:2.

When ON and OFF states are arranged in the periods of T2, T1 and T0 in the 4 frames, a display of 21 kinds of gradation is possible. For example, FIG. 17 shows an example of a gradation display in a case that the ratio of T2, T1 and T0 is 6:3:1. Further, FIG. 18 shows an example of a gradation display in a case that the ratio of T2, T1 and T0 is 6:3:2. The gradation levels in FIG. 17 are 21 kinds of 0/20–20/20, and the gradation levels in FIG. 18 are 21 kinds of 0/22, 2/22–20/22 and 22/22.

In FIGS. 17 and 18, f1, f2, f3 and f4 indicate respectively a frame number wherein "1" represents ON and "0" represents OFF. In this Example also, a change point of voltage level applicable in the selection periods occurs only a change point between T1 and T0 in the second frame or the fourth frame. Accordingly, a possibility of distortion of the waveform is small and an increase of an uneven display is prevented.

Figure 19:
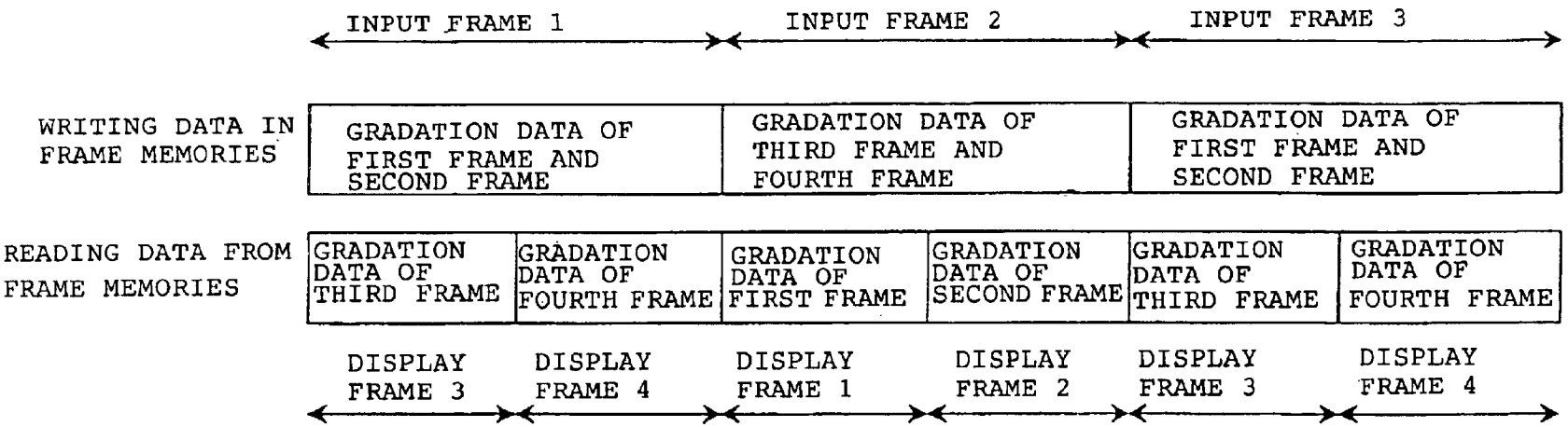
FIG. 19 is a diagram showing how the gradation data in Example 3 and Example 4 are written in and read from frame memories.

The operations of the liquid crystal driving device 10 in this Example will be described with reference to FIGS. 16 and 19. FIG. 19 is a diagram showing how data are written into or read from the frame memories 12.

In writing gradation data in the frame memories 12, it is possible to write into the frame memories 12 6-bit data comprising 3-bit gradation data [b2, b1, b0] showing ON/OFF displays in the period T2 of the first frame and the periods T1, T0 of the second frame and 3-bit gradation data [b2, b1, b0] showing ON/OFF displays in the period T2 of the third frame and the periods T1, T0 of the fourth frame. However, when such control is conducted, the capacity of the frame memories 12 is increased and cost for the display device is increased.

In consideration of the above-mentioned, the writing and reading of the gradation data are conducted on input frames, as standard, which indicate a time during which image data for one picture are inputted. Namely, as shown in FIG. 19, the gradation processing circuit 11 modifies the image data 100 inputted in the period of an input frame 1 into gradation data [b2, b1, b0] for the first frame and the second frame, and the modified data are written in the frame memories 12. In the period of the successive input frame 2, image data 100 are modified into gradation data [b2, b1, b0] for the third frame and the fourth frame, and the modified data are written in the frame memories 12.

The MLA operating circuit 13 reads b2 in the period T2 of the first frame, b1 in the period T1 of the second frame and b0 in the period T0 of the second frame respectively, among the gradation data [b2, b1, b0] stored in the frame memories 12 in the period of the input frame 1. Further, the operating circuit 13 reads b2 in the period T2 of the third frame, b1 in the period T1 of the fourth frame and b0 in the period T0 of the fourth frame respectively, among the gradation data [b2, b1, b0] stored in the frame memories in the period of the input frame 2.

In conducting the above-mentioned control, the writing and reading of 3-bit data are conducted with respect to the frame memories 12 in the same manner as Example 1, and therefore, it is unnecessary to increase the capacity of the memories.

The timing control circuit 15 controls in such a manner that the ratio of the time ratio of the first frame to the second frame to the time ratio of the third frame to the fourth frame is 6:4 and the time ratio as a result of dividing the selection periods in the second and fourth frames is 3:1 in a case that the ratio of the divided T2, T1 and T0 is 6:3:1. Further, it controls in such a manner that the ratio of the time ratio of the first frame to the second frame to the time ratio of the third frame to the fourth frame is 6:5 and the time ratio as a result of dividing the selection periods of the second and fourth frames is 3:2 in a case that the ratio of divided T2, T1 and T0 is 6:3:2.

In the same manner as the above-mentioned Examples, the timing control circuit 15 controls time ratios by changing the output timing of the latch signals.

In this Example, the time ratio of the first frame to the second frame is the same as the time ratio of the third frame to the fourth frame. Further, the time ratios obtained by dividing the selection periods of the second and fourth frames are same. Accordingly, control of timing is conducted with a unit of 2 frames in view of only the output timing of the latch signals.

EXAMPLE 4

Figure 20:
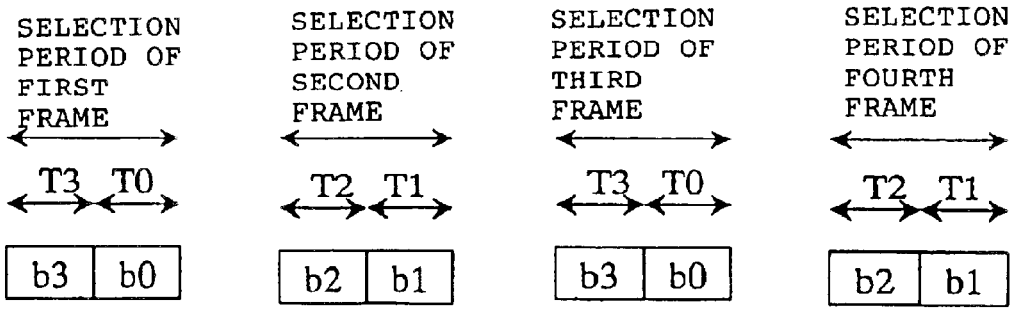
FIG. 20 is a diagram showing how to divide selection periods in Example 4.

Example 4 for conducting a display of 45 gradation levels with 4 frames will be described. In this Example, as shown in FIG. 20, selection periods in the first frame and the third frame are divided respectively into T3 and T0, and selection periods in the second frame and the fourth frame are divided respectively into T2 and T1. The time ratio of T3, T2, T1 and T0 is 12:6:3:1 or 12:6:3:2.

When ON and OFF states are arranged in the periods of T3, T2, T1 and T0 in the 4 frames, a display of 45 kinds of gradation is possible. FIG. 21 shows an Example of a gradation display in a case that the ratio of T3, T2, T1 and T0 is 12:6:3:1. Further, FIG. 22 shows an Example of a gradation display in a case that the ratio of T3, T2 T1 and T0 is 12:6:3:2. The gradation levels in FIG. 21 are 45 kinds of 0/44–44/44, and the gradation levels in FIG. 22 are 45 kinds of 0/46, 2/46–44/46 and 46/46. In FIGS. 21 and 22, f1, f2, f3 and f4 indicate respectively a frame number wherein "1" indicates ON and "0" indicates OFF.

When the above-mentioned division is made on the selection periods, a change point of voltage levels applicable in the selection periods occurs at a change point between T3 and T0 in the first frame and the third frame and a change point between T2 and T1 in the second frame and the fourth frame. Namely, only three times of change of voltage levels take place in the 4 frames. Accordingly, a distortion of the waveform does not increase and an uneven display is not increased.

The operations of the liquid crystal driving device 10 in this embodiment will be described with reference to the diagrams of FIGS. 19 and 20.

The gradation processing circuit 11 modifies image data 100 inputted in the period of an input frame 1 to be gradation data [b3, b2, b1, b0] for the first frame and the second frame, and the modified data are written in the frame memories 12. In the successive period of an input frame 2, the processing circuit 11 modifies image data 100 to be gradation data [b3, b2, b1, b0] for the third frame and the fourth frame, and the modified data are written in the frame memory 12.

The MLA operating circuit 13 reads b3 and b0 in the periods T3 and T0 of the first frame, and b2 and b1 in the periods T2 and T1 of the second frame respectively, among the gradation data [b3, b2, b1, b0] stored in the frame memories 12 in the period of the input frame 1. Further, the operating circuit 13 reads b3 and b0 in the periods T3 and T0 of the third frame, and b2 and b1 in the periods T2 and T1 of the fourth frame respectively, among the gradation data [b3, b2, b1, b0] stored in the frame memories in the period of the input frame 2.

The timing control circuit 15 controls in such a manner that the ratio of the time ratio of the first frame to the second frame to the time ratio of the third frame to the fourth frame is 13:9; the ratio of the division of the selection periods in the first and third frames is 12:1, and the time ratio of the division of the selection periods in the second and fourth frames is 6:3 in a case that the ratio of divided T3, T2, T1 and T0 is 12:6:3:1.

Further, the control circuit 15 controls in such a manner that the ratio of the time ratio of the first frame to the second frame to the time ratio of the third frame to the fourth frame is 13:9; the ratio of the division of the selection periods in the first and third frames is 12:2, and the time ratio of the division of the selection periods in the second and fourth frames is 6:3 in a case that the ratio of divided T3, T2, T1 and T0 is 12:16;3:2.

In the same manner as the above-mentioned Examples, the timing control circuit 15 controls the time ratios by changing the output timing of the latch signals. Further, in this Example, the time ratio of the first frame to the second frame is the same as the time ratio of the third frame to the fourth frame, and the time ratio of the division of the selection periods in the first and third frames is the same as the time ratio of the division of the selection periods in the second and fourth frames. Accordingly, control of timing is conducted in a unit of 2 frames in view of only the output timing of the latch signals.

As described above, in each of the above-mentioned Examples, control of the timing is so made that the time ratio of the first frame to the second frame is different in two continuously displayed frames, and so that the selection period of either or both frames of the first frame and the second frame is divided to have a different time ratio. Specifically, on Examples 1 to 4, the time ratio is controlled as shown in FIG. 23.

The time ratio of the first frame to the second frame can be chosen depending on a required number of gradation levels and so on. However, if there is a remarkable different, the operating frequency becomes high in a shorter frame, and accordingly, it is undesirable. On the other hand, if there is a little difference, it is often required to shorten the selection period after the selection period of a frame is divided. Under these circumstances, it is appropriate that the time ratio of the first frame to the second frame is within about 50–90%.

Further, when a gradation display is realized with 4 continuous frames, the time ratio of the third frame to the fourth frame is the same as the time ratio of the first frame to the second frame. Namely, even in the case that a gradation display is realized with 4 frames, the time ratio of two continuous frames (for example, a frame of odd number and a frame of even number) is the same.

As described above, according to the driving method or the driving device for a liquid crystal display device of the present invention, in two continuously displayed display frames, the time ratio of a display frame to the other should be determined to have a figure selected from a range of 50 to 90%; the selection period of either one or both the two display frames is divided into two portions, and ON data and OFF data are mixed in each of the divided periods in a combination of at least one of the two display frames to effect a gradation display by pulse width modulation. Accordingly, a display of high quality can be obtained while occurrence of an uneven display is controlled even by increasing the number of gradation levels. Namely, it is possible to improve a ratio of division of the selection period of a frame or frames without increasing the number of division. For example, a display of multi-gradation, e.g., 8 or 16 gradation levels with 2 frames, or 21 to 45 gradation levels with 4 frames becomes possible.

Figure 24:
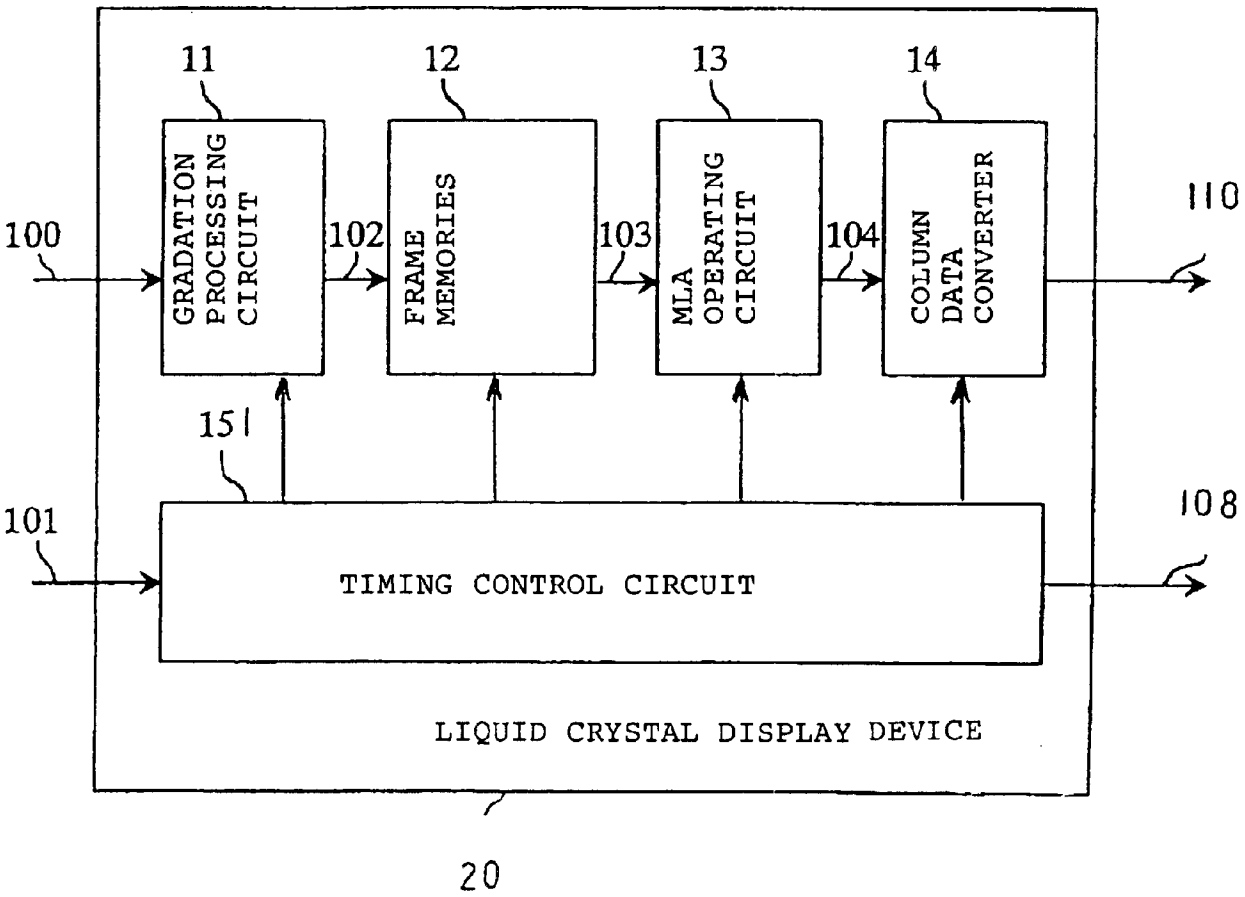
FIG. 24 is a block diagram showing the liquid crystal display device according to another embodiment of the present invention.

Another embodiment of the present invention will be described. FIG. 24 is a block diagram showing an embodiment of the liquid crystal driving device conducting the multiplex line simultaneous selection driving according to the present invention. A liquid crystal driving device 20 shown in FIG. 24 is adapted to receive image data 100 and control signals 101 to output column data signals 110 to column drivers, and to output control signals 108 to the column drivers and row drivers. The control signals 101 include dot clock signals, vertical synchronizing signals, horizontal synchronizing signals, data-enabling signals indicating an effective term of image data, and so on.

The image data 100 with gradation signals, which have been inputted to the liquid crystal driving device 20, are inputted to a gradation processing circuit 11. The gradation processing circuit 11 modifies the received image data 100 to be gradation data 102 indicating gradation levels for each display frame and writes the modified data in frame memories 12. The frame memories 12 hold the written gradation data until the data are read several times for conducting the multiple line simultaneous selection driving method (MLA driving).

A MLA operating circuit 13 reads gradation data 103 from the frame memories 12 to produce voltage patterns to be applied to column electrodes by conducting a multiple line simultaneously selecting operation. Then, the voltage patterns, as column data signals 104 are outputted to a column data converter 14. The column data converter 14 converts the voltage patterns produced in the MLA operating circuit 13 into voltage pasterns which hinders an uneven display, and the converted voltage patterns are outputted to the column drivers.

A timing control circuit 151 produces control signals needed to each circuit block and control signals 108 to be supplied to the column drivers and the row drivers.

The liquid crystal driving device 20 is also provided with a row selection pattern generator, although it is omitted in FIG. 24, which supplies to the row drivers row selection pattern signals prepared based on an orthogonal matrix.

Operations of the liquid crystal driving device 20 will be described. The image data 100 with gradation signals, which have been inputted to the liquid crystal driving device 20, are inputted to the gradation processing circuit 11. The gradation processing circuit 11 modifies the received image data 100 to be gradation data 102 corresponding to gradation levels for each display frame and writes the modified gradation data in the frame memories 12. For example, when a display of intermediate gradation of 5 gradation levels by dividing the selection period into 4 portions, the gradation data 102 are 3-bit data so that 5 kinds of gradation levels of 0/4–4/4 are distinguished.

Figure 10:
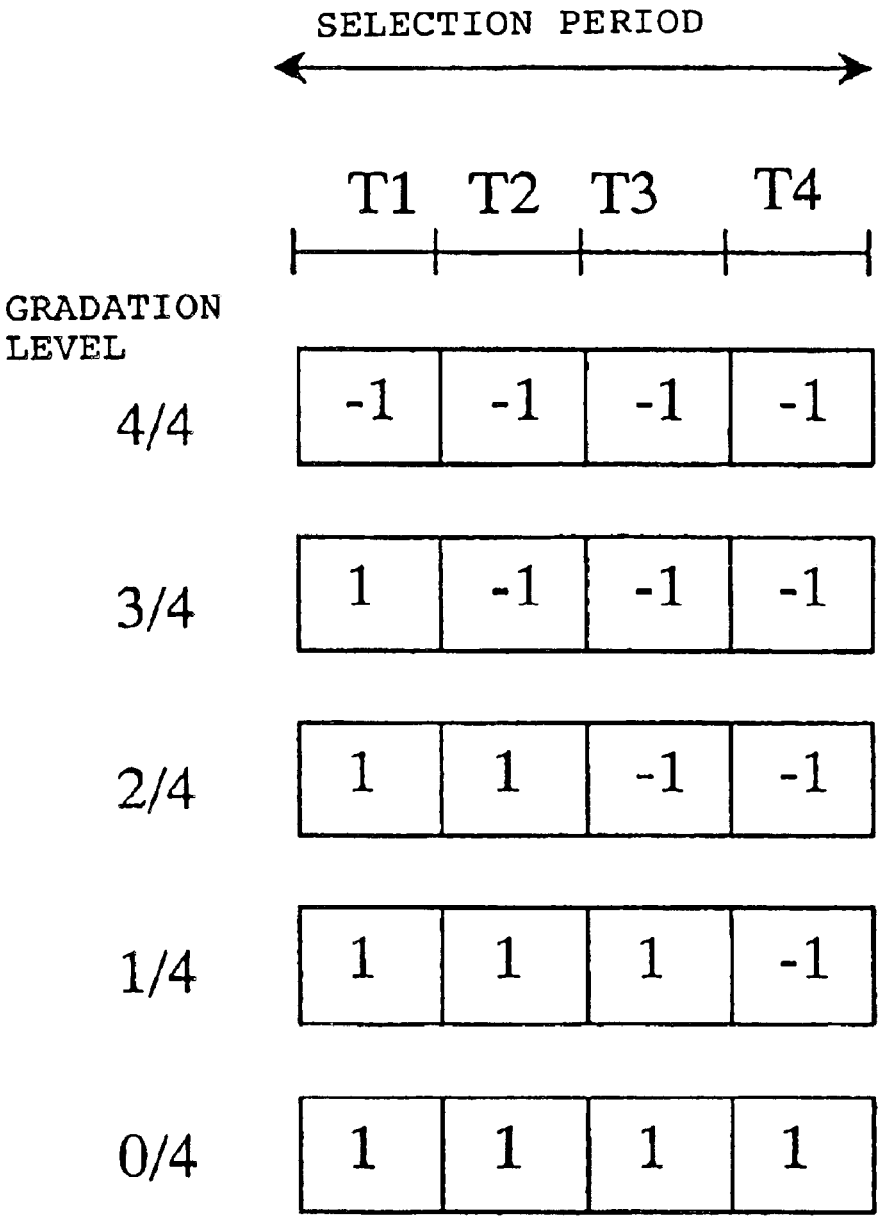
FIG. 10 is a diagram showing an example of a usual PWM system.

Namely, the gradation processing circuit 11 produces 3-bit data corresponding to the gradation levels as shown in FIG. 10, for each display frame, and writes the produced data, as the gradation data 102, in the frame memories 12. The frame memories 12 hold the written gradation data until they are read several times for multiple line simultaneously selecting driving.

The MLA operating circuit 13 reads out gradation data 103 from the frame memories 12. In the example shown in FIG. 10, the 3-bit gradation data are converted into 4-bit data showing ON displays and OFF displays in each of the periods T1–T4 in the 4-divided selection periods. Then, imaginary data are produced on the display data of simultaneously selected 3 lines so that the number of voltage levels applied to the column electrodes in each of the divided periods T1–T4 is made 2 levels.

Figures 9A, 9B:
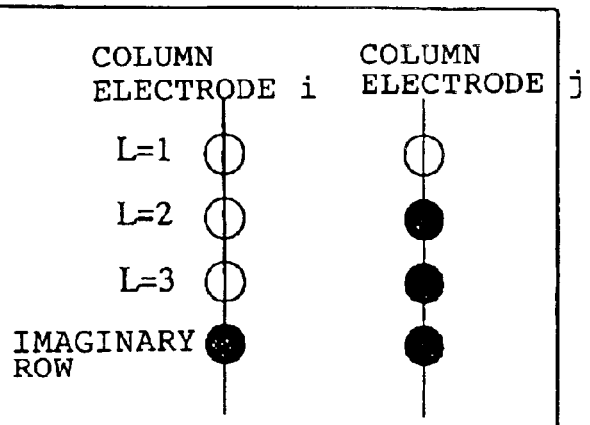
FIG. 9A is a diagram showing an example of a selection matrix and display data.
FIG. 9B is a diagram showing an example of image display patterns and voltage patterns.

For example, when the Hadamard's matrix of 4 rows and 4 columns shown in FIG. 9A is used for producing a row selection pattern, data of the imaginary row (imaginary data) are determined so that the sum of the values obtained by the product of bits between the row selection pattern and the data of the simultaneously selected 3 lines of row and the imaginary row, on each of the divided periods T1–T4, for each selection periods of the first to fourth selections, indicates "+1" or "−1". Then, a applicable voltage pattern is formed by arranging "+1" and "−1" as the result of the summing.

Since "−1" is expressed as "0" and "+1" is expressed as "1" in a practically used circuit, the MLA operating circuit 13 produces a voltage pattern by conducting exclusive OR operations to the corresponding bits. The produced voltage pattern is outputted as the column data signals 104 to the column data converter 14.

Figure 11A:
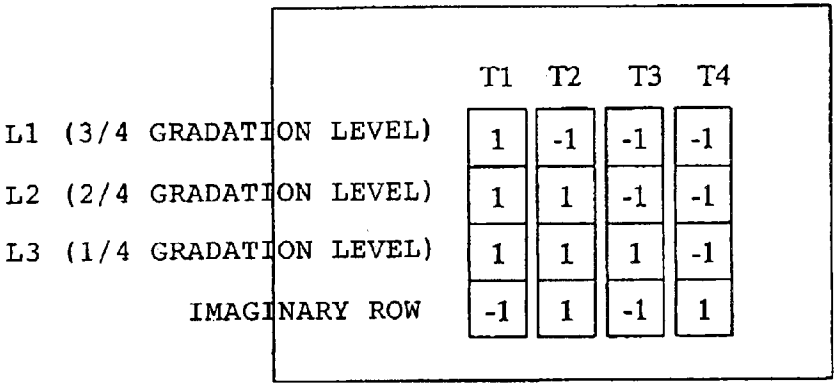
FIG. 11A is a diagram showing an example of an ON/OFF display in divided periods in which a PWM method is applied to a multiple line simultaneously selecting method with an imaginary row.
Figure 11C:
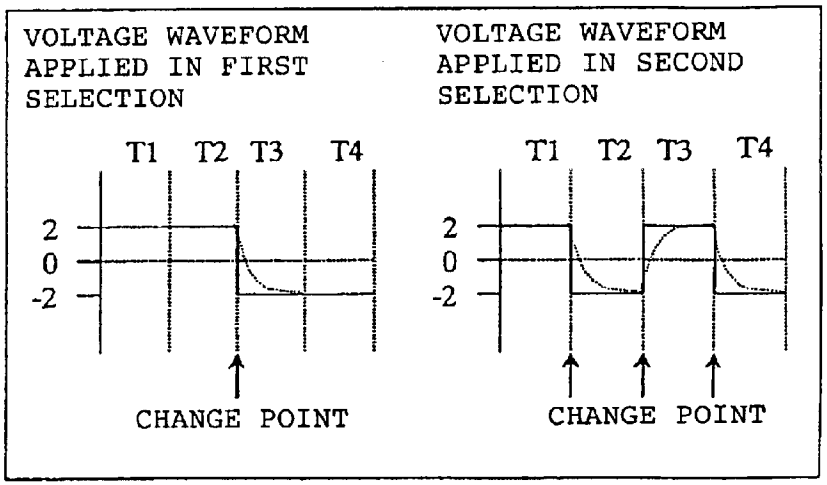
FIG. 11C is a diagram showing an example of the waveform of applied voltages in a first selection time and a second selection time.
Figure 11B:
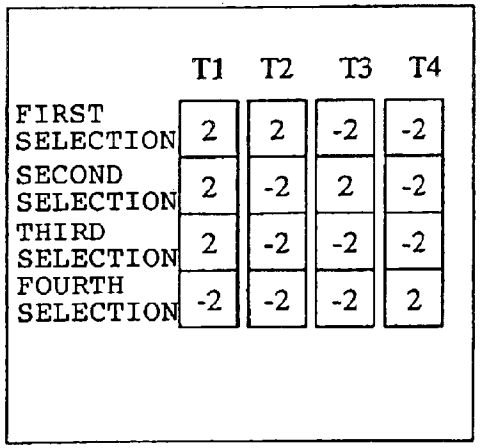
FIG. 11B is a diagram showing an example of voltage patterns applied to column electrodes.

The gradation data of 3 display lines (L1, L2, L3) consist of a 3/4 gradation level, a 2/4 gradation level and a 1/4 gradation level, there occur 3 change points of voltage level in the second selection period as shown in FIG. 11C. As described before, an uneven display is increased due to a deformation of the waveform at the change point of voltage level. In this embodiment, the column data converter 14 converts the voltage pattern signals produced in the MLA operating circuit 13 into a voltage pattern which hinders an increase of an uneven display.

Figure 25:
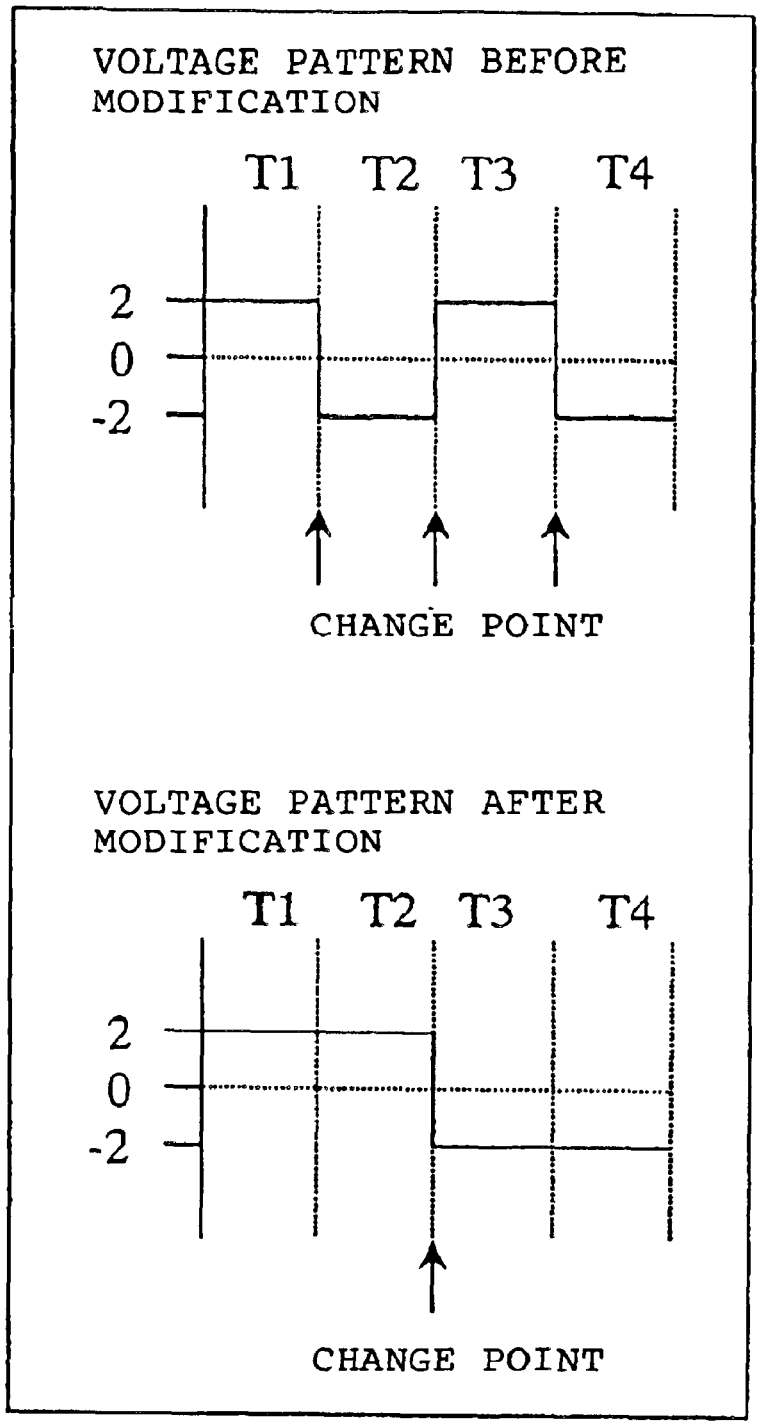
FIG. 25 is a timing diagram for explaining the operations of a data converter.

Operations of the column data converter 14 are described with reference to a timing diagram in FIG. 25 which shows voltage patterns before and after a voltage pattern is modified by the column data converter. In a voltage pattern before modification, the voltage levels in T1–T4 assume (2, −2, 2, −2) in this order. However, the column data converter 14 exchanges the order of T2 and T3 to be (2, 2, −2, −2). Then, in the voltage pattern after modification, there is only one change point of voltage level.

Accordingly, a loss of an effective value of applied voltage caused by a dull voltage waveform is reduced, and an increase of an uneven display is prevented. For another voltage pattern, the column data converter 14 modifies the waveform so that the change point is single if there are three change point. Thus, the column data converter 14 outputs column data signals 110 by modifying a voltage pattern so that the change point of voltage level is single.

Figure 26:
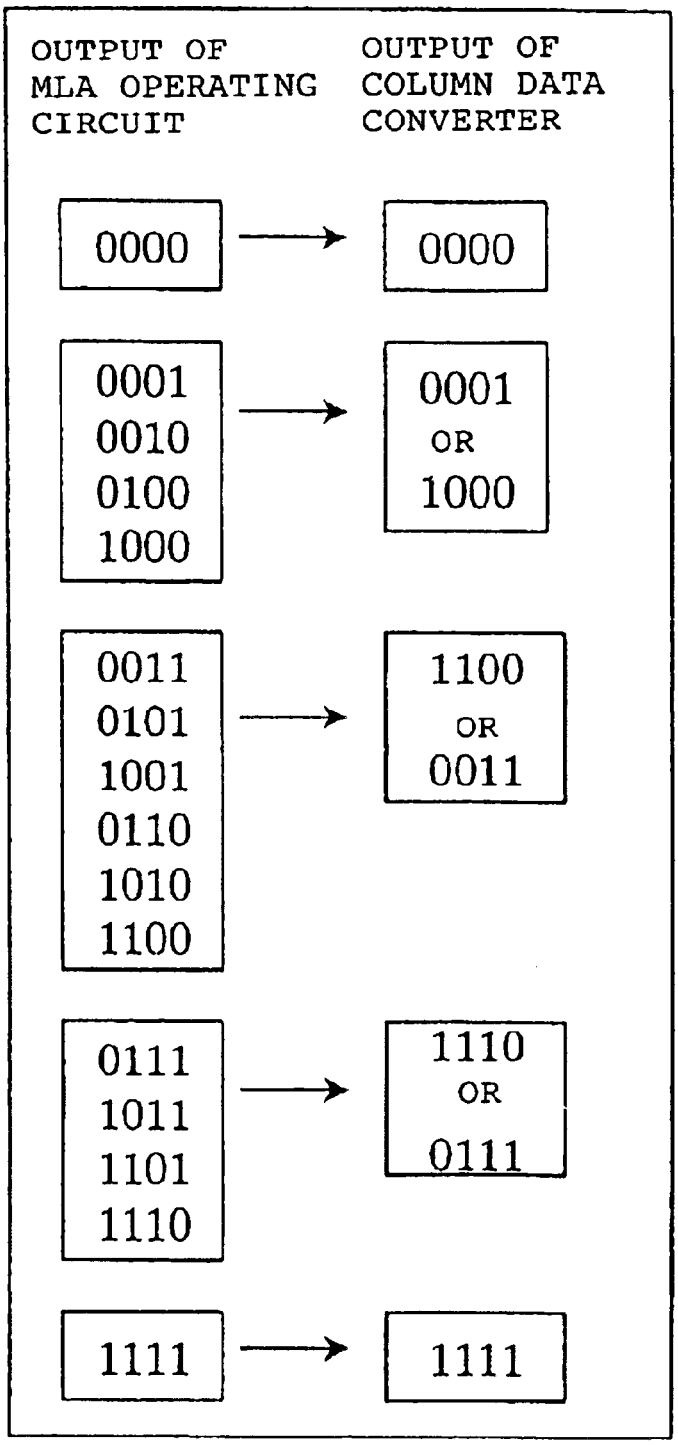
FIG. 26 is a diagram showing a relation of voltage patterns from a MLA operating circuit to voltage patterns by a column data converter.

FIG. 26 is a diagram showing an example of the relation of voltage patterns on the column data signals 104 which can be outputted from the MLA operating circuit 13 to voltage patterns on the column data signals 110 after having been modified by the column data converter 14 in this example. In the voltage patterns in FIG. 26, a higher voltage is expressed by "1" and a lower voltage is expressed by "0".

In the voltage patterns outputted from the MLA operating circuit 13, there are two patterns of [0, 1, 0, 1] and [1, 0, 1, 0] which have 3 change points. As shown in FIG. 26, these patterns can be modified by the column data converter 14 to be [1, 1, 0, 0] or [0, 0, 1, 1].

Further, the column data converter 14 modifies voltage patterns which have 2 change points to have voltage patterns in which there is only one change point. Namely, the patterns of [0, 0, 1, 0] and [0, 1, 0, 0] are transformed into [0, 0, 0, 1] or [1, 0, 0, 0]. Further, the patterns of [1, 0, 0, 1] and [0, 1, 1, 0] are transformed into [1, 1, 0, 0] or [0, 0, 1, 1]. Further, the patterns of [1, 0, 1, 1] and [1, 1, 0, 1] are transformed into [1, 1, 1, 0] or [0, 1, 1, 1].

The modifications as shown in FIG. 26 can easily be realized by a suitable combination of logic circuits. In a liquid crystal driving circuit comprising LSI, a space occupied by such logic circuits is small. Further, such a construction that the patterns before the modification are memorized as address data, and the data after the modification are data in designated addresses, can easily be realized by ROM.

The column data converter 14 outputs the column data signals 110 indicating the voltage patterns after the modification to the column drivers. Then, the timing control circuit 151 outputs latch signals by which the data is taken into the column drivers. The column drivers, which has received the latch signals, applies to the column electrode voltages corresponding to the inputted data whereby the liquid crystal display device is driven. Row selection pattern signals generated from the row selection pattern generator are outputted to row drivers. The row drivers apply predetermined voltages to the row electrodes of the liquid crystal panel depending on the row selection pattern signals.

In the above-mentioned Examples, a selection period is divided uniformly. However, it is possible to divide a selection period ununiformly. Namely, when the division is approximately made so as to reduce the number of the change point of voltage level in a selection period even in a case that the division is made ununiformly, occurrence of an uneven display can be controlled.

Further, in the above-mentioned Example, the driving device of the present invention comprises the MLS driving device, the column drivers and the row drivers which are provided independently. However, the column driver circuit may be installed in the driving device, or the MLA driving device may include a circuit for the column drivers and the row drivers.

In the driving method and the driving device for a liquid crystal display device of the present invention, the construction is so made that voltage patterns are modified to reduce the number of change point of voltage level to be applied to the row electrodes in a selection period. Accordingly, a loss of an effective value of voltages due to a dull waveform of voltage can be reduced. Accordingly, a uniform display can be obtained while an uneven display is controlled.

Figure 27:
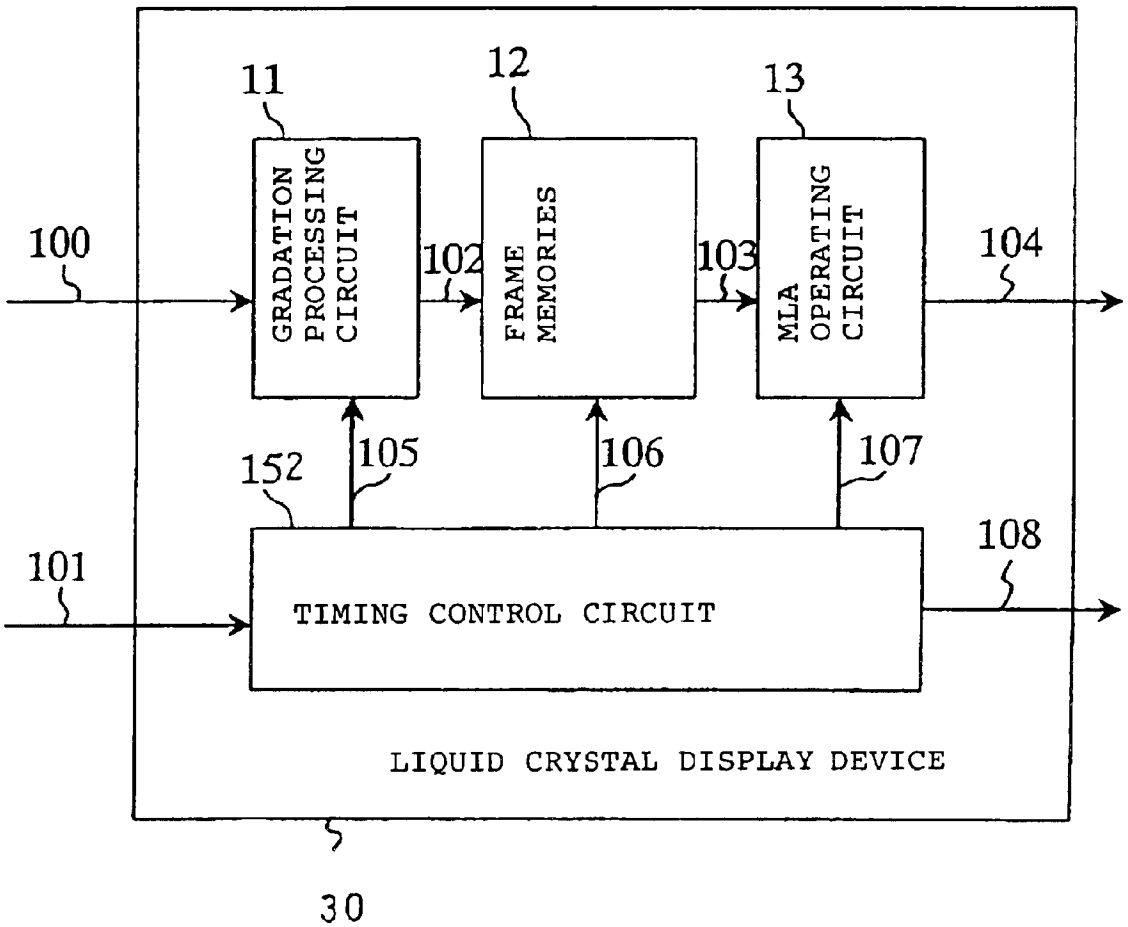
FIG. 27 is a block diagram showing the liquid crystal driving device according to another embodiment of the present invention.

Another embodiment of the present invention will be described with reference to FIG. 27 which is a block diagram showing an embodiment of the liquid crystal driving device for effecting multiple line simultaneously selecting driving. A liquid crystal driving device 30 shown in FIG. 27 is adapted to receive image data 100 and control signals 101 to output column data signals 104 to column drivers, and to output control signals 108 to the column drivers and row drivers. The control signals 101 include dot clock signals, vertical synchronizing signals, horizontal synchronizing signals, data-enabling signals indicating an effective term of image data, and so on.

The liquid crystal driving device 30 is also provided with a row selection pattern generator, although it is omitted in FIG. 27, which supplies to the row drivers row selection pattern signals prepared based on the orthogonal matrix as shown in FIG. 2.

The image data 100 with the gradation signals inputted to the liquid crystal driving device 30 are inputted to a gradation processing circuit 11. The gradation processing circuit 11 converts the inputted image data 100 into gradation data 102 indicating gradation levels for each display frame and writes the converted data in frame memories 12. The frame memories 12 hold the written gradation data until the data are read several times for conducting multiple line simultaneously selecting driving (MLA driving).

A MLA operating circuit 13 reads gradation data 103 from the frame memories 12 to produce voltage patterns to be applied to column electrodes by conducting operations for selecting simultaneously multiple lines as shown in FIG. 3. Then, the voltage patterns are outputted to the column drivers, as the column data signals 104. Further, row selection pattern signals from the row selection pattern generator are outputted to the row drivers. A timing control circuit 152 produces control signals 105, 106, 107 needed to each circuit block and control signals 108 to the column drivers and the row drivers.

The column drivers apply voltages for driving liquid crystal to the column electrodes of the liquid crystal panel based on the column data signals 104. The row drivers apply predetermined voltages to the row electrodes based on the row selection pattern signals.

Operations of the liquid crystal driving device shown in FIG. 27 will be described referring to FIGS. 28–41.

EXAMPLE 5

Figures 28, 29:
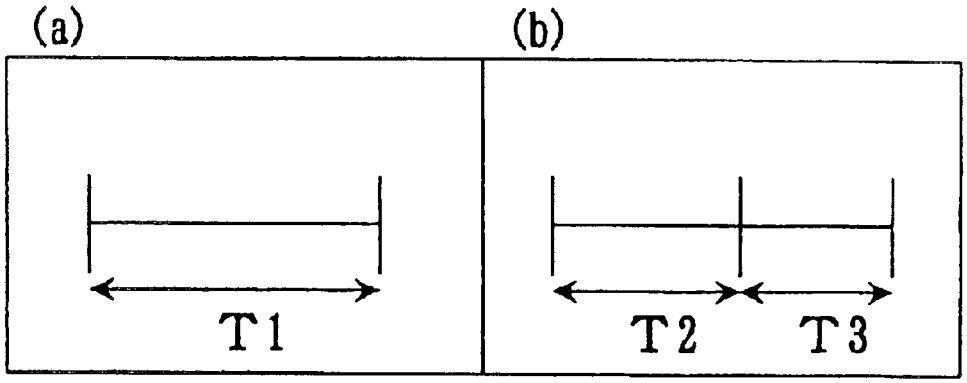
FIG. 28 is a diagram showing Embodiment 5 for conducting a display of 8 gradation levels in a period of 2 frames.
FIG. 29 is a diagram showing ON/OFF states in selection periods T1–T3 in Example 5.

FIG. 28 is a diagram showing an example in which a display of 8 gradation levels is conducted in a period of 2 frames. FIG. 28(*a*) shows the selection period of a first frame period, and FIG. 28(*b*) shows the selection period of a second frame period. The time ratio of the first frame period to the successive second frame period is determined to be 4:5. Then, the selection period of each frame is 4:5.

Further, the selection period of the second frame is divided into a proportion of 3:2. Then, as shown in FIG. 28, the first selection period is T1, the first divided period of the second selection period is T2 and the second divided period of the second selection period is T3. The time ratio of T1, T2, T3 is 4:3:2. Accordingly, the length of the selection period of the first frame is different from the selection period of the second frame. In the case of determining the time ratio of the selection periods to be different, it is possible to determine the time ratio of a largest frame period to the smallest frame period to be 51–90%, for example. Further, as driving conditions for achieving a variety of display performance with the same unit, 55–80% is preferable. Further, in order to reduce the occurrence of a flicker in each frame and to achieve an easily visible display, it is preferable to use a time ratio within a range of 60–75%.

When ON/OFF data are arranged in each of the periods T1, T2, T3 according to each of the gradation levels wherein "1" is made correspondent to an ON display and "0" is to an OFF display, the lowest intermediate display (OFF) is provided by selecting "1" to all the periods T1, T2,, T3, and the highest intermediate display (ON) is provided by selecting "1" to all the periods T1, T2, T3. Further, intermediate gradation levels are provided by a suitable combination of an ON display and an OFF display in the periods T1, T2, T3.

For example, a case that a dot-matrix type liquid crystal element having 120 lines of row is used and 4 lines of row are successively selected by MLA method with use of an orthogonal matrix of 4×4, is assumed. When the shortest period in which an effective voltage corresponding to ON or OFF is applied to each of the pixels is considered to be 1 frame period, the 1 frame period is 120 selection periods since the number of times to select one line of row in 1 frame period is 4.

In this example, the division of period is not conducted in the selection period of the first frame, and the division is conducted to only the selection period of the second frame. Accordingly, a change of voltage level during the selection periods of the first and second frames occurs at only the change point between T2 and T3 in the second frame. Therefore, there is a small possibility of causing a distortion of the waveform of applicable voltages by reducing the number of change point, and occurrence of an uneven display can be reduced.

FIG. 29 is a diagram showing ON/OFF states in each of the selection periods T1–T3 in this example. An intermediate gradation level can be expressed by a combination of "1" and "0" wherein "1" indicates ON and "0" indicates OFF in the display data in the periods T1–T3.

When a value in the period T1, a value in the period T2 and a value in the period T3 are respectively weighted with 4, 3 and 2, and the values obtained in these periods are added together, voltage levels of intermediate gradation can be obtained. As shown in FIG. 29, a display having the highest intermediate gradation level (ON) has a value 9 and a display having the lowest intermediate gradation level (OFF) has a value 0. The voltage level values of intermediate gradation show substantially uniformly arranged 8 gradation levels except for the voltage level value adjacent to the highest intermediate gradation (ON) and the voltage level value adjacent to the lowest intermediate gradation (OFF).

FIG. 29 shows each of effective voltage values standardized based on the highest voltage level. Although FIGS. 0–9 indicated as voltage level values in FIG. 29 do not correctly correspond to effective voltage values actually applied to the pixels, they can be used as reference values.

Figure 30:
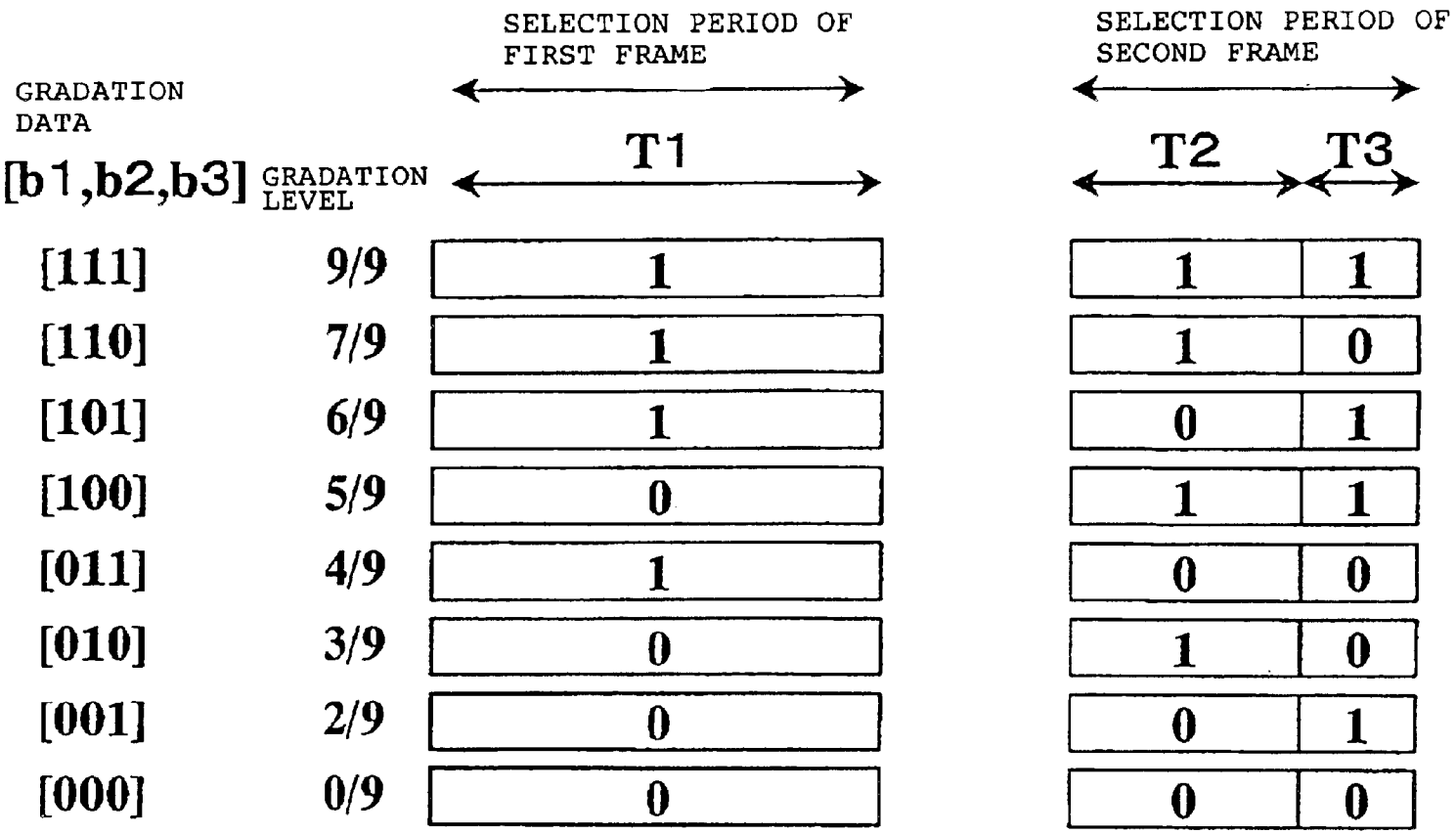
FIG. 30 is a diagram showing ON/OFF states in selection periods T1, T2, .T3 in the Example 5.

FIG. 30 shows a relation of ON and OFF in the periods T1, T2, T3 of the first and second frames with respect to each of the gradation levels wherein "1" indicates an ON display and "0" indicates an OFF display. The lowest gradation level 0/9 shows an OFF display in each of the periods T1, T2, T3, and the highest gradation level 9/9 shows an ON display in each of the periods T1, T2, T3. Intermediate gradation levels include at least one ON display and at least one OFF display in the periods T1, T2, T3 as shown in FIG. 30.

In order to obtain the above-mentioned intermediate gradation, the gradation processing circuit 11 in the liquid crystal driving device 30 produces 3-bit gradation data [b1, b2, b3] based on image data 100 with gradation signals, the gradation data being written in the frame memories 12. When 8 gradation levels are expressed by 0/9–7/9, the relation of the gradation data to the gradation levels is such that as shown in FIG. 30, [b1, b2, b3]=[000] indicates the gradation level 0/9 and [b1, b2, b3]=[111] indicates the gradation level 9/9.

The MLA operating circuit 13 reads b1 in the period of the first frame, b2 and b3 in the periods T2 and T3 of the second frame respectively, among the gradation data [b1, b2, b3] stored in the frame memories 12 so that column data signals 104 ([c1, c2, c3]) to be outputted to the column drivers are produced. The timing control circuit 15 controls latch signals to be supplied to the column drivers so that the time ratio of the first frame to the second frame is 4:5, and the time ratio of the divided selection periods in the second frame is 3:2.

Figure 31:
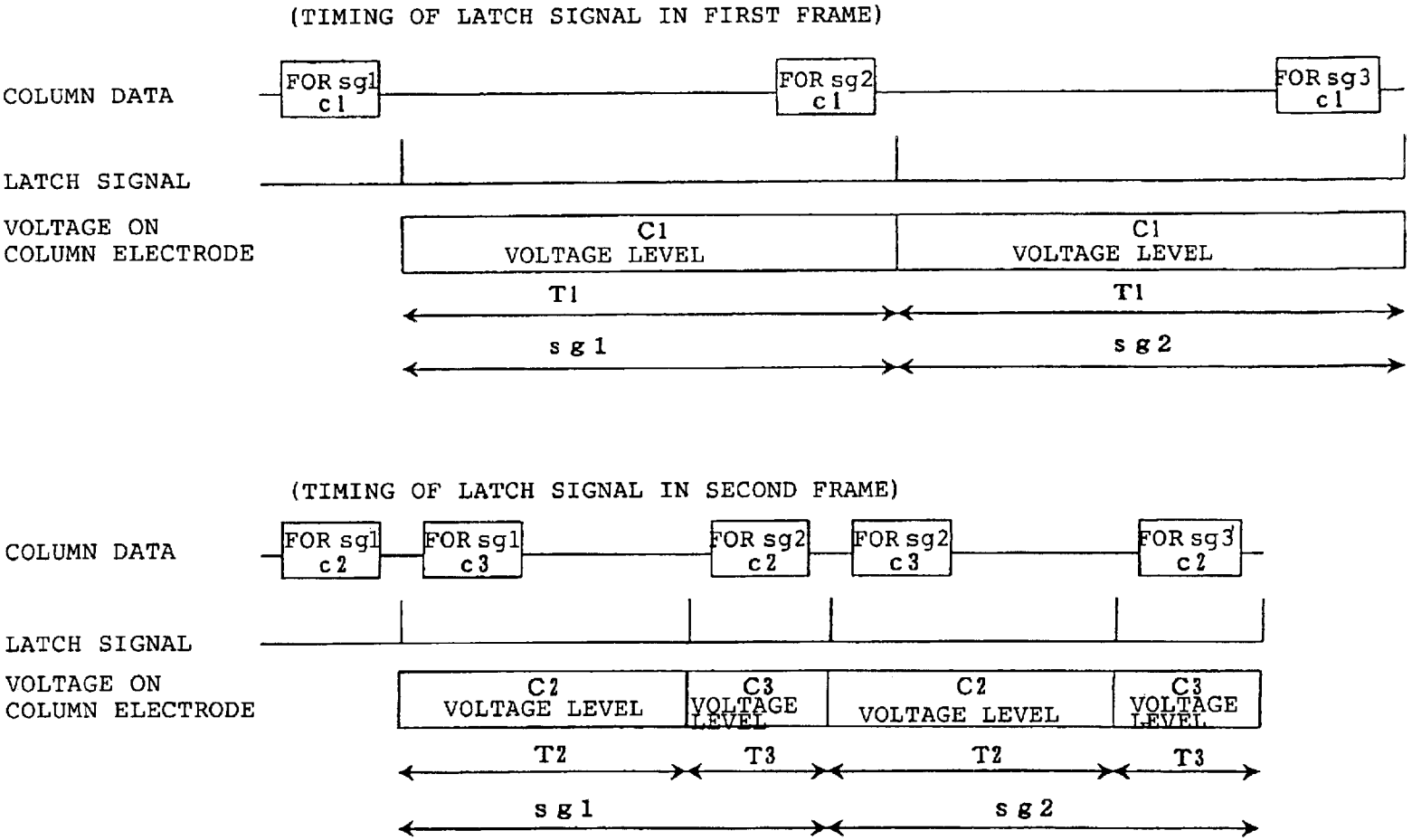
FIG. 31 is a diagram showing timings of latch signals outputted from the timing controlling circuit.

FIG. 31 is a timing diagram showing the timing of the latch signals outputted from the timing control circuit 152. When column data signals (column data) c1 on the first subgroup (sg1) are outputted from the MLA operating circuit 13 to the column drivers, the timing control circuit 152 outputs a latch signal by which data are taken by the column drivers. Upon receiving the latch signal, the column drivers apply to column electrodes voltages corresponding to the inputted data to drive the liquid crystal.

Similarly, column data cl for the second subgroup (sg2) are outputted from the MLA operating circuit 13 to the column drivers and the timing control circuit 152 outputs a latch signal to the column drivers. Then, predetermined voltages are applied to the column electrodes. Accordingly, a period between the present latch signal and the next latch signal indicates the selection period T1 as the selection period of the first subgroup.

For the second frame, the column data c2 on the first subgroup (sg1) are outputted from the MLA operating circuit 13 to the column drivers, and a latch signal is outputted from the timing control circuit 152 to the column drivers. Then, predetermined voltage are applied to the column electrodes. Then, column data c3 are outputted from the MLA operating circuit 13 to the column drivers and a latch signal is outputted from the timing control circuit 152 to the column drivers whereby predetermined voltages are applied to the column electrodes. Voltages are applied to the column electrodes in the same manner as described above.

FIG. 31 shows a relation of periods of latch signal to the periods T2 and T3. Thus, the timing control circuit 152 controls the periods of T1, T2, T3 to have a time ratio of 4:3:2 by changing the output timing of the latch signals.

COMPARATIVE EXAMPLE 1

Figures 32, 33:
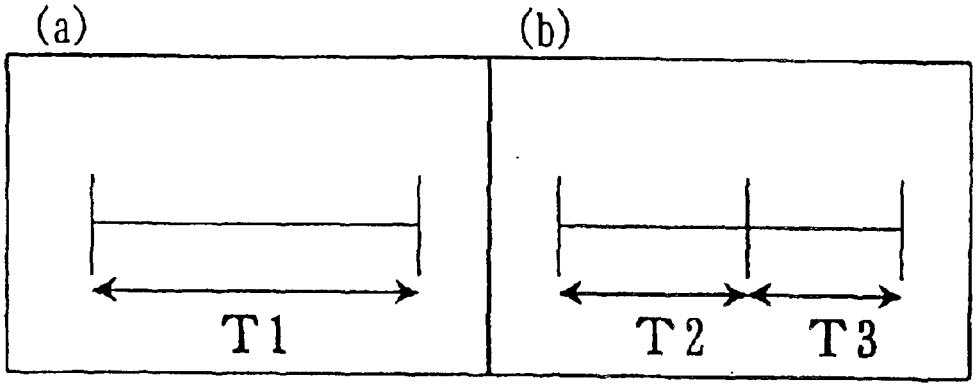
FIG. 32 is a diagram showing an ON/OFF state in selection periods T1, T2 in Comparative Example 1.
FIG. 33 is a diagram showing ON/OFF states in selection periods T1, T2 in Comparative Example 2.

As a Comparative Example, a case that the period of the first frame is equal to the period of the second frame which is subsequent to the first frame, will be described. FIG. 32 is a diagram showing an ON/OFF state in each of the selection periods T1, T2 in Comparative Example 1. In FIG. 32, the selection period of the first frame is T1, and the selection period of the second frame is divided into a proportion of 2:3 wherein the first divided period of the second frame is T2 and the second divided period is T3. Intermediate gradation levels are obtained by assigning ON/OFF data to each of the periods T1–T3. In the same manner as the case of Example 5, when a value for the period T1, a value for the period T2 and a value for the period T3 are weighted respectively with values 5, 3 and 2, and the values in each of these periods T1, T2 and T3 are added respectively, voltage levels of intermediate gradation can be obtained. However, in the voltage levels obtained in this Comparative Example, only 7 ununiform gradation levels are resulted. Comparative Example 1 is different from Example 5 in the point that the selection period of the first frame is equal to the selection period of the second frame. In the Comparative Example 1, there are overlapping voltage levels in several combination of ON and OFF between T1 and T2. Accordingly, the number of gradation levels obtained is smaller than that of Example 5. Namely, when the length of the selection period of the first frame is equal to the length of the selection period of the second frame, a display of multiple gradation levels can not practically be obtained.

COMPARATIVE EXAMPLE 2

In the following, a case that the length of the selection period of the first frame is not equal to the length of the selection period of the second frame, and each selection period of these frames is divided, will be described. In the Comparative Example 2, each of the selection period in the first and second frames is divided into 2:3 wherein the divided selection periods are T1 and T2. Then, intermediate gradation levels are obtained by assigning ON/OFF data to the selection periods T1, T2 of the frames.

FIG. 33 is a diagram showing ON/OFF states in the selection periods T1, T2 in Comparative Example 2. In the same manner as the case of Example 5, when a value for the period T1 and a value for the period T2 are weighted respectively with 2 and 3, and the obtained values are added together, a voltage level of intermediate gradation can be obtained. In this case, 9 gradation levels wherein the voltage levels are divided uniformly, can be obtained.

Accordingly, the number of gradation levels of Comparative Example 2 is more than that of Example 5 by 1. However, since the selection periods of both the first frame and the second frame are divided, the number of change of applicable voltage level per unit time is increased in comparison with that of Example 5. Accordingly, a crosstalk is apt to take place and the quality of display is reduced.

As described above, in the case of Example 5 that the selection period of the first frame is different from that of the successive second frame, and the selection period of either one frame is divided, a crosstalk which may cause a deterioration of the quality of display can be controlled in spite of increasing the number of voltage levels, in comparison with the cases of Comparative Examples 1 and 2.

EXAMPLE 6

FIG. 34 is a diagram showing ON/OFF states in the selection periods T1, T2 in Example 6. In this Example, the ratio of the period of the first frame to the period of the second frame successive to the first frame is made 6:5 so that the proportion of selection periods of the frames is 6:5. Then, the selection period of the second frame is divided to be 3:2.

Here, the selection period of the first frame is T1, the first divided period of the selection period of the second frame is T2 and the second divided period of the selection period of the second frame is T3. Then, intermediate gradation levels can be obtained by assigning display data of ON or OFF in the period T1–T3 of the first and second frames.

When ON or OFF are assigned to each of the periods T1–T3 as shown in FIG. 34, and a value for the period T1, a value for the period T2 and a value for the period T3 are weighted respectively with 6, 3 and 2, and the obtained values are added together, each voltage level can be obtained. In FIG. 34, the level number of the highest intermediate display level (ON) is 22 and the level number of the lowest intermediate display level (OFF) is 0. The number of voltage levels is 21 wherein the values of voltage level are distributed substantially uniform except for the voltage level adjacent to the highest intermediate gradation display (ON) and the voltage level adjacent to the lowest intermediate gradation display (OFF).

In a case that display data to be inputted are the data of 4-bit and 16 gradation levels, it is necessary to select 16 gradation levels among 21 gradation levels. Here, a method of selecting 16 gradation levels among 21 gradation levels is described with reference to FIG. 35.

Each value shown in (a) in FIG. 35 shows each voltage level value obtained by the above-mentioned method. Further, values shown in (b) in FIG. 35 are values of actually displayed 16 voltage levels selected from the voltage levels shown at a left side in (a). As in (b) in FIG. 35, in the vicinity of the highest intermediate gradation display (ON) and the lowest intermediate gradation display (OFF), there are relatively large number of voltage levels which are not used actually for display in comparison with an intermediate region, and relatively large number of voltage levels in the intermediate region between ON and OFF are used as voltage levels to be actually displayed.

When a voltage level value indicating an effective voltage value used for the highest intermediate gradation display (ON) is A and a voltage level value indicating an effective voltage value used for the lowest intermediate gradation display (OFF) is B, the number of voltage level values contained in a range of not less than L and less than U in the following Formulas (1) and (2) is 16:

$$L=(A-B)\times 0.25+B \quad (1)$$

$$U=(A-B)\times 0.75+B \quad (2)$$

In this Example, A=22 and B=0. Accordingly, the voltage level values contained in the range of not less than L and less than U are 6–16 from (a) in FIG. 35. Among them, the voltage level values of 7–16 are employed as shown in (b) in FIG. 35. Accordingly, 63% in 16 voltage levels used actually for display is contained in the range of not less than L and less than U.

When a distribution of voltages to be used for an actual display is made correspondent with the distribution of voltages as described above, and various images such as computer graphics are displayed, an excellent display could be obtained while it was unnecessary to adjust voltages for regulating brightness.

In order to realize the above-mentioned gradation display, the gradation processing circuit 11 in the liquid crystal driving device 10 produces 3-bit gradation data [b1, b2, b3] from inputted image data 100 having gradation signals, and the produced data are written in frame memories 12. In this case, the gradation data [b1, b2, b3] are produced in response to gradation levels on the basis of the relations shown in FIGS. 34 and (b) of FIG. 35.

COMPARATIVE EXAMPLE 3

As a Comparative Example with respect to Example 6, 16 uniformly distributed voltage levels, which were formed by dividing a selection period to be 1:2:4:8 in terms of time and assigning data of ON or OFF in each of the 4-divided time region, were used. With use of the voltage levels, various images such as computer graphics were displayed. Then, it was necessary to adjust the voltages to regulate the brightness because there was unnaturalness every time in changing a display.

In this case, Formulas (1) and (2) were applied in the same manner as the case of Example 6 provided that A=15 and B=0. Then, the number of voltage level values contained in a range of not less than L and less than U show 50% among 16 levels.

Figure 36:
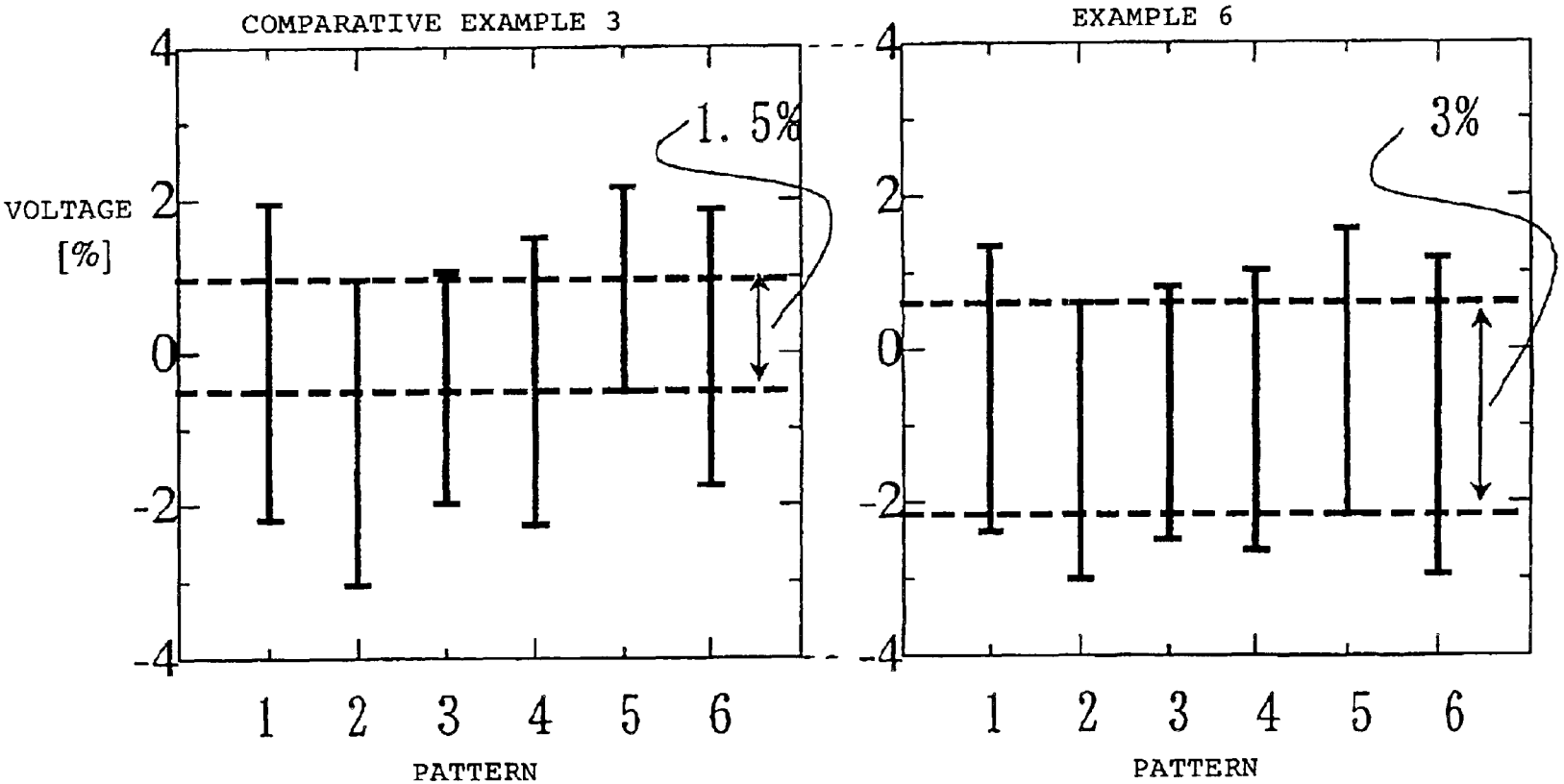
FIG. 36 is a diagram showing a permissible voltage range in Example 6 and Comparative Example 3.

Tests of visibility were conducted. A result is shown in FIG. 36. Namely, the liquid crystal panel was driven with use of the system according to Example 6 and the system according to Comparative Example 3 to display 6 kinds of patterns. Ranges of voltages permissible in visibility were specified.

6 Kinds of patterns as shown in FIG. 37 were used.

Image numbers 1–6 correspond respectively to the numbers 1–6 in the abscissa in FIG. 36. The voltages (%) in FIG. 36 are respectively percentages of voltage within ranges (permissible ranges) in which the pattern of each display is judged to be easy to see on an effective voltage value as reference value. Namely, if adjustment is made on a voltage out of the range shown in FIG. 36, the display pattern becomes difficult to see.

In the system used in Comparative Example 3 as shown in FIG. 36, a permissible voltage range was changed depending on display patterns. Further, voltage values at an upper limit and a lower limit varied, and a voltage region which was unnecessary to adjust voltages with respect to each pattern was small. On the other hand, in the system according to Example 6, there was substantially no change of the permissible voltage range depending on patterns. Further, there was little change of the voltage value itself at its upper and lower limits. Accordingly, when various kinds of patterns are displayed, a voltage range which unnecessitates voltage adjustment is broader than that of the system according to Comparative Example 3.

There is considered the following reason. Human tends to seek a contrastive display in brightness or darkness in a relatively bright image or dark image. In this case, a contrastive display can be obtained by reducing sufficiently voltage levels in the gradation data to be displayed, in a bright image until relatively low voltage levels show darkness. On the other hand, in a case of dark image, a contrastive display can be obtained by reducing sufficiently voltage values in the gradation data to be displayed until relatively high voltage levels show darkness.

Accordingly, when there are many voltage levels concentrated in the middle portion between ON and OFF, the number of relatively low voltage levels is increased in a bright image, and in a dark image, the number of relatively high voltage levels is increased whereby the width of voltage adjustment can relatively be reduced. Namely, it is possible to obtain an acceptable displayed image with respect to various display patterns without making voltage adjustment. This technique is applicable not only to the liquid crystal display device but also a display element in general.

EXAMPLE 7

Figure 38:
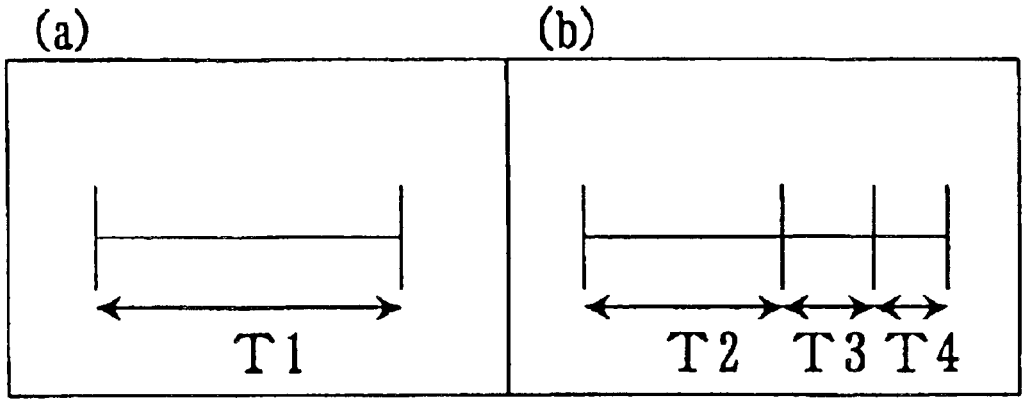
FIG. 38 is a diagram showing an ON/OFF state in selection periods T1, T2 in Example 7.

FIG. 38 is a diagram showing ON/OFF states in the selection periods T1, T2 in Example 7. In this Example, the ratio of the first frame period to the second frame period subsequent to the first frame period is 12:11 so that the selection periods of these frames is 12:11. Further, the selection periods of the second frame is divided into 3 portions to be 6:3:2. Then, definition is so made that the first selection period is T1, and the first divided period, the second divided period and the third divided period of the second selection period are T2, T3 and T4 respectively.

With respect to 2 sets wherein the first and second frame periods constitute 1 set, intermediate gradation levels can be obtained by assigning display data of ON or OFF in T1–T4. In the same manner as the case of Example 5, a value for the period T1, a value for the period T2, a value for the period T3 and a value for the period T4 are weighted respectively with 12, 6, 3 and 2, and obtained values are added together. Then, each value of voltage levels are obtainable.

As shown in (a) in FIG. 39, the voltage level in the highest intermediate gradation display (ON) is 46 and the voltage level in the lowest intermediate gradation display (OFF) is 0. Further, the number of voltage levels are 45 voltage levels, which are distributed substantially uniform, except for the voltage level adjacent to the highest intermediate display (ON) and the voltage level adjacent to the lowest intermediate gradation display (OFF).

In a case that display data to be inputted are display data of 5 bits and 32 gradation levels, it is necessary to select 32 gradation levels among the obtainable 45 gradation levels. Here, a method for selecting 32 gradation levels among 45 gradation levels is described.

Each value shown in (a) in FIG. 39 is a voltage level value obtained by the above-mentioned method. Further, each value shown in (b) indicates a value of 32 voltage levels to be used for actual display, which are selected from the values of voltage levels shown in (a) in FIG. 39. As shown in (b) in FIG. 39, there are relatively many voltage levels, which are not used for an actual display, in the vicinity of the highest intermediate gradation display (ON) and the lowest intermediate gradation display (OFF) in comparison with voltage levels in the intermediate region, and relatively large voltage levels in the intermediate region between ON and OFF are employed as voltage levels to be actually displayed.

In the application of the above-mentioned formulas (1) and (2), since A=46 and B=0 in this Example, the values of voltage level contained in the range of not less than L and less than U are within 12–34 in view of (a) in FIG. 39.

Among them, the values of voltage level of 13–34 are used as shown in (b) in FIG. 39. Accordingly, 69% of voltage levels among 32 voltage levels which are actually used for a display is contained in the range of not less than L and less than U.

The above-mentioned distribution of voltages was used for an actual display, and various images such as an image of nature was displayed. As a result, an excellent picture image was obtained without requiring voltage adjustment to regulate the brightness.

COMPARATIVE EXAMPLE 4

As Comparative Example comparable with Example 7, a case that a selection period is divided to have time proportions of 1:2:4:8 in the same manner as Comparative Example 3; data of ON or OFF are assigned to these 4-divided time regions, and there are uniformly distributed 64 number of voltage levels in which 4 frames are made 1 unit, is shown. FIGS. 40A and 40B are respectively diagrams showing ON/OFF states in these divided periods in Comparative Example 4.

As shown in FIG. 40A, the number of gradation levels obtained by 1 frame are 16 levels of 0–15. Accordingly, it is possible to realize 64 gradation levels with 4 frames. Then, as shown in FIG. 40B, almost no voltage level values in the vicinity of the highest level and the lowest level were not selected, but voltage level values in an intermediate level region were dominantly selected.

In this case, the formulas (1) and (2) wherein A is 63 and B is 0 were applied in the same manner as the case of Example 7. Then, the percentage of voltage level values contained in the range of not less than L and less than U is 84% in 32 voltage levels.

An image of nature was displayed using the gradation levels selected as described above. As a result, there were many crosstalks; reproducibility of colors was poor in comparison with the image displayed with CRT, and a display free from unnaturalness could not be obtained even by conducting voltage adjustment.

EXAMPLE 8

In the same manner as Comparative Example 4, a selection period was divided to have time proportions of 1:2:4:8: data of ON or OFF were assigned to these 4-divided selection periods, and uniformly distributed 64 voltage levels in which 4 frames were made a unit, were used. In this case, a displayed image of excellent quality could be obtained by properly selecting voltage levels.

Figure 41:
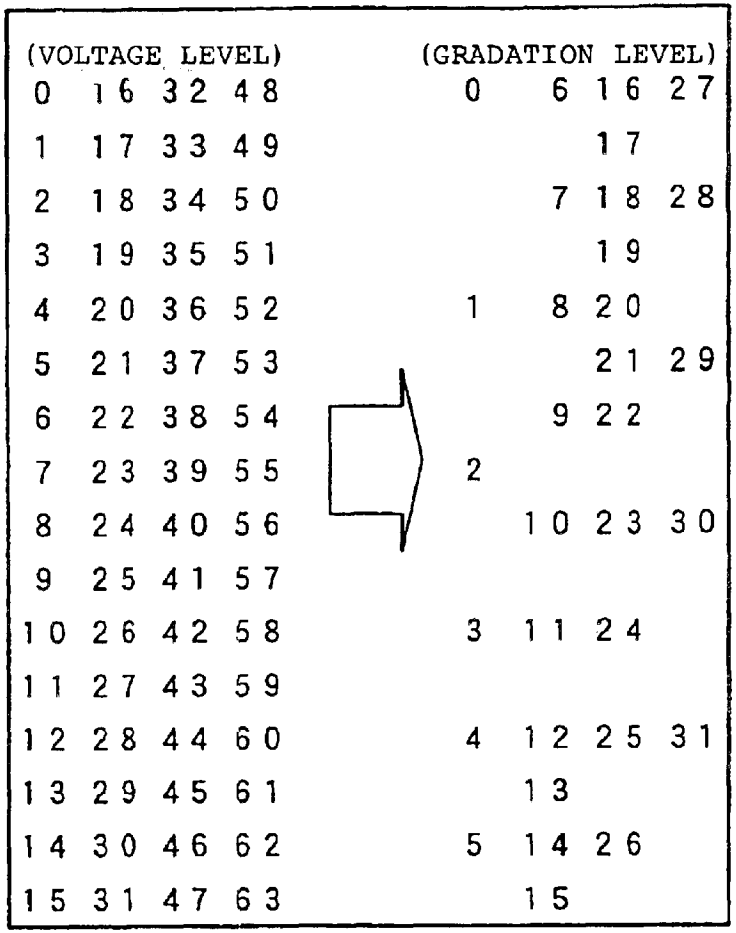
FIG. 41 is a diagram for explaining a method of selecting 32 gradation levels from 64 gradation levels.

In Example 8, the number of voltage levels contained in the range of not less than L and less than U wherein A was 63 and B was 0, was 22 as shown in FIG. 41. Such number was 63% in 32 voltage levels actually used for display. When an image of nature was displayed by using the selected voltage levels, an excellent display free from unnaturalness could be obtained without requiring voltage adjustment to regulate the brightness although there were found crosstalks.

As described in the above-mentioned Examples, when a plurality of voltage levels are produced in which on-data and off-data are mixed in selection periods formed by dividing a selection period of at least one frame in two display frames, and voltage levels used for a gradation display are selected from the produced voltage levels wherein a relatively small number of voltage levels in the vicinity of the highest level and the lowest level are selected, whereas a relatively large number of voltage levels in an intermediate range of voltage levels are selected, a display having an excellent image can be obtained without requiring voltage adjustment for regulating the brightness.

Further, as described in the above-mentioned Examples, in producing an m number of intermediate voltages between effective voltage values of the highest level and the lowest level where A represents a value indicative of the effective voltage value applied to a case of ON display and B represents the value indicative of the effective voltage value applied to a case of OFF display in selected voltage levels, the number of gradation levels q contained in the range of not less than L and less than U satisfying the above-mentioned formulas (1) and (2) is preferably in a range of about $$0.55<q/m<0.75 \quad (3)$$

In Examples 5 to 7, the time ratio of the selection period of the first frame period and the second frame period subsequent to the first frame period is made a predetermined ratio and the selection period of either one or both frames is divided to have a predetermined ratio. However, the present invention includes such a case that an intermediate gradation display sequence is formed with a plurality of frame periods of at least 3 frame periods wherein the selection period of at least one frame period among them is made different from that of other frame periods and the selection period of at least one frame is divided to have a plurality of selection periods. In this case, a display of intermediate gradation can be obtained by mixing properly data of ON and OFF in the divided selection periods and an undivided selection period.

In the above-mentioned Examples, description has been made as to a case of using MLA method according to a voltage averaging method wherein the maximum effective voltage value of ON and OFF satisfies:

$$V\text{on}/V\text{ off}=\sqrt{((\sqrt{N})+1)/((\sqrt{N})-1))}$$

where Von represents an effective voltage value applied to a pixel corresponding to ON and Voff represents an effective voltage value applied to a pixel corresponding to OFF. However, the present invention is applicable to a case of using a line successive driving method.

When a liquid crystal panel was driven by using the line successive driving method and producing intermediate voltages satisfying the formulas (1) and (2), a display showing images free from unnaturalness without requiring voltage adjustment could be obtained even though a plurality kinds of images such as nature which required multi-gradation levels.

Further, in a non-effective voltage responsive type matrix display element without subjecting to the voltage averaging method, when a brightness level or a reflectance which satisfies the formulas (1) and (2) is generated wherein A represents a brightness or a reflectance corresponding to ON and B represents a brightness or a reflectance corresponding to OFF, a display of image free from unnaturalness without requiring voltage adjustment can be obtained.

For example, when a brightness level satisfying the formula (1) and (2) wherein A represents a luminance in an ON time and B represents a luminance in an OFF time, a display of image free from unnaturalness without requiring voltage adjustment can be obtained by using a self-emitting type element such as an organic EL (electroluminescence) element.

As described above, according to the gradation level producing method of the present invention, the period of at least one frame in a plurality of continuous display frames is made different from the period of other frames; the selection period of at least one frame among the plurality of display frames is divided to form divided selection periods; on-data and off-data are provided in the selection period of the undivided frame and the divided selection periods to produce a plurality of voltage levels, and the produced voltage levels are used wherein the voltage levels in the vicinity of the highest level and the lowest level are thinned. Since the thinning of voltage levels at a lower side and a higher side of gradation levels, driving for a gradation display is easy and a various kind of display are obtainable.

In particular, since a relatively small number of voltage levels are selected in the vicinity of the highest level and the lowest level, and a relatively large number of voltage levels in an intermediate level are selected, it is possible to display of various kinds of images and of an excellent quality, without conducting adjustment of brightness level such as voltage adjustment.

Further, in the driving device for a liquid crystal display device to be driven by MLA method, according to the present invention, a q number of gradation data satisfying the relation of the formula (3) in the range of not less than L and less than U determined by the formulas (1) and (2) wherein A represents the value indicating the highest voltage level and B represents the value indicating the lowest voltage level in a plurality of voltage levels and there are an m number of intermediate voltages between A and B, are selected. Accordingly, it is possible to display various kinds of images having an excellent quality in the liquid crystal display device without conducting voltage adjustment.

Obviously, numerous modifications and variations of the present invention are possible in light of the above teachings. It is therefore to be understood that within the scope of the appended claims, the invention may be practiced otherwise than as specifically described herein.

The present invention can be practiced by the ways as described herein in reference to JP11-51914, JP11-65686 and JP11-67862.

What is claimed is:

1. A driving method for a liquid crystal display device, the method comprising:

selecting simultaneously a plurality of lines of row electrodes in a liquid crystal display device comprising a plurality of row electrodes and a plurality of column electrodes; and applying predetermined voltages to the selected lines of the row electrodes during a selection period, wherein the selection period of at least a display frame is divided into divided selection periods such that any two divided selection periods of the selection period have a first predetermined ratio, which is different than 1, the predetermined voltages are applied to the lines of row electrodes during the divided selection periods, and column electrodes are driven with a voltage pattern by reducing a number of changes of voltage levels in each of the divided selection periods, and two selection periods corresponding to two continuous display frames have a second predetermined ratio, which is different than 1.

2. The driving method for a liquid crystal display device according to claim 1, wherein in two continuous display frames to be displayed, the time ratio of a display frame period to the other is determined to have a figure selected from a range of 50 to 90%; the selection period of at least one of the two display frames is divided into two portions, and on-data and off-data are mixed in each of the divided periods in a combination of at least one in the two display frames to effect a gradation display by pulse width modulation.

3. The driving method for a liquid crystal display device according to claim 2, wherein the time ratio between the two continuous display frames to be displayed is 4:3 and the selection period of a shorter frame is divided to have a time ratio of 2:1.

4. The driving method for a liquid crystal display device according to claim 2, wherein the time ratio between the two continuous display frames to be displayed is 9:6; the selection period of a longer frame is divided to have a time ratio of 8:1, and the selection period of a shorter frame is divided to have a time ratio of 4:2.

5. The driving method for a liquid crystal display device according to claim 2, wherein on-data and off-data are mixed in each of the divided periods in two sets of combination of the two display frames to effect a gradation display by pulse width modulation.

6. The driving method for a liquid crystal display device according to claim 1, wherein an imaginary row is formed in addition to the lines of row electrodes; a selection period is divided into a plurality of divided periods; a voltage pattern is changed so as to reduce a change point of voltage level applied to column electrodes in the one selection period, and a gradation display is effected by applying voltages to column electrodes according to the changed voltage pattern.

7. The driving method for a liquid crystal display device according to claim 1, wherein an imaginary row is formed in addition to the lines of row electrodes; a selection period is divided uniformly into a plurality of divided periods; a voltage pattern to be applied to column electrodes is determined, and a gradation display is effected by applying voltages to column electrodes with use of a voltage pattern in which there is a single change point of voltage level to be applied to the column electrodes in one selection period.

8. A driving method for a display device having display elements in a matrix form and producing voltage levels for effecting gradation display, the method comprising:

setting a selection period of at least one frame period to be different from that of another frame period, in a plurality of continuous display frames;

dividing the selection period of at least one frame in the plurality of display frames into divided selection periods such that any two divided selection periods of the selection period have a predetermined ratio which is different than 1; and providing on-data and off-data in the selection period of a non-divided frame period and the divided selection periods to produce a plurality of voltage levels, wherein the plurality of voltage levels are used for a display except for the voltage levels in the vicinity of highest and lowest voltage levels, wherein the plurality of voltage levels are applied to the display elements during the divided selection periods, and wherein column electrodes are driven with voltage patterns by reducing a number of changes of the voltage levels in each of the divided selection periods.

9. The driving method for a display device according to claim 8, wherein among the plurality of voltage levels, voltage levels in the vicinity of the highest level and the lowest level are used relatively rare and voltage levels in an intermediate region are used relatively often.

10. The driving method for a display device according to claim 8, wherein the method is used for driving a liquid crystal display device wherein a multiple line simultaneously selecting method is used.

11. The driving method for a display device according to claim 8, wherein in producing an m number of intermediate voltages between A and B where A represents the highest voltage level and B represents the lowest voltage level among the plurality of voltage levels, the number of gradation levels q selected from a range of not less than L and less than U given by Formulas (1) and (2) satisfies the relation of Formula (3):

$$L=(A-B)\times 0.25+B \quad (1)$$

$$U=(A-B)\times 0.75+B \quad (2)$$

$$0.55<q/m<0.75 \quad (3).$$

12. The driving method for a display device according to claim 9, wherein in producing an m number of intermediate voltages between A and B where A represents the highest voltage level and B represents the lowest voltage level among the plurality of voltage levels, the number of gradation levels q selected from a range of not less than L and less than U given by Formulas (1) and (2) satisfies the relation of Formula (3):

$$L=(A-B)\times 0.25+B \quad (1)$$

$$U=(A-B)\times 0.75+B \quad (2)$$

$$0.55<q/m<0.75 \quad (3).$$

13. The driving method for a display device according to claim 10, wherein among the plurality of voltage levels, voltage levels in the vicinity of the highest level and the lowest level are used relatively rare and voltage levels in an intermediate level are used relatively often.

14. The driving method for a display device according to claim 10, wherein in producing an m number of intermediate voltages between A and B where A represents the highest voltage level and B represents the lowest voltage level among the plurality of voltage levels, the number of gradation levels q selected from a range of not less than L and less than U given by Formulas (1) and (2) satisfies the relation of Formula (3):

$$L=(A-B)\times 0.25+B \quad (1)$$

$$U=(A-B)\times 0.75+B \quad (2)$$

$$0.55<q/m<0.75 \quad (3).$$

15. The driving method for a display device according to claim 13, wherein in producing an m number of intermediate voltages between A and B where A represents the highest voltage level and B represents the lowest voltage level among the plurality of voltage levels, the number of gradation levels q selected from a range of not less than L and less than U given by Formulas (1) and (2) satisfies the relation of Formula (3):

$$L=(A-B)\times 0.25+B \quad (1)$$

$$U=(A-B)\times 0.75+B \quad (2)$$

$$0.55<q/m<0.75 \quad (3).$$

16. A driving device for a liquid crystal display device for selecting simultaneously a plurality of lines of row electrodes in a liquid crystal display device comprising a plurality of row electrodes and a plurality of column electrodes, and applying predetermined voltages to the selected row electrodes during a selection period, the driving device comprising:

means for driving column electrodes according to a predetermined voltage pattern in each period formed by dividing a selection period of a display frame so that any two of the divided selection periods have a different time ratio; and means for supplying a timing signal to the plurality of column electrodes, wherein the selection period of at least a display frame is divided into the divided selection periods, the predetermined voltages are applied to the lines of row electrodes during the divided selection periods, and column electrodes are driven with a voltage pattern by reducing a number of changes of voltage levels in each of the divided selection periods, and two selection periods corresponding to two continuous display frames have a predetermined ratio, which is different than 1.

17. The driving device for a liquid crystal display device according to claim 16, wherein the driving device is adapted to select simultaneously a plurality of lines of row electrode and an imaginary row in a liquid crystal display device comprising a plurality of row electrodes and a plurality of column electrodes and apply predetermined voltages to the selected row electrodes during a selection period, and wherein the driving means comprises a gradation processing means for producing gradation data based on inputted image data to write the gradation data in frame memories, and a column data producing means for determining a voltage pattern to be applied to column electrodes in each period which is formed by dividing uniformly a selection period, whereby control is made so that when there are a plurality of change points of voltage level to be applied to the column electrodes in a selection period, only one change point is provided.

18. The driving device for a liquid crystal display device according to claim 16, wherein the driving means comprises:

means for providing timing signals to column drivers for driving column electrodes so that the frame period of at least one frame in a plurality of continuous display frames is made different from that of other frame, and the selection period of at least one frame in the plurality of display frames is divided to form divided selection periods, means for processing a gradation, including a circuit for producing gradation data based on inputted image data to write the gradation data in frame memories, wherein the gradation data are such that the number of gradation levels q selected from a range of not less than L and less than U given by Formulas (1) and (2) satisfies the relation of Formula (3) in producing an m number of intermediate voltages between A and B where A represents the highest voltage level and B represents the lowest voltage level among the plurality of voltage levels, and means for producing column data by reading sequentially gradation data stored in the frame memories in the selection period of a frame in the plurality of frames and the selection period of a subframe, the produced column data being supplied to the column drivers:

$$L=(A-B)\times 0.25+B \quad (1)$$

$$U=(A-B)\times 0.75+B \quad (2)$$

$$0.55<q/m<0.75 \quad (3).$$

19. A driving device for a liquid crystal display device for selecting simultaneously a plurality of lines of row electrodes in a liquid crystal display device comprising a plurality of row electrodes and a plurality of column electrodes and applying predetermined voltages to the selected row electrodes during a selection period, the driving device comprising:

means for driving the plurality of lines of row electrodes;

means for forming a combination of at least one of two continuous display frames in which a time ratio of a display frame period to the other is within 50–90%, and for supplying a timing signal to column drivers for driving column electrodes, so that a selection period of at least one of the two continuous display frames is divided into two portions to produce an n (n: an integer of at least 3) number of divided periods, wherein the predetermined voltages are applied to the lines of row electrodes during the divided selection periods and such that any two divided selection periods of the selection period have a predetermined ratio, which is different than 1;

means for producing n-bit gradation data based on inputted image data to write the n-bit gradation data in frame memories; and means for producing column data by reading sequentially the n-bit gradation data which are stored in the frame memories in the respective divided periods and for supplying the produced data to the column drivers, wherein the column data processing means converts the data into a form to reduce a number of changes of voltage levels in each of the divided selection periods.

20. The driving device for a liquid crystal display device according to claim 19, wherein the timing control means produces the timing signal so that the total time of the continuously displayed two display frames is equal to a time of an input frame to which image data are inputted.

21. A driving method for a liquid crystal display device, the method comprising:

selecting simultaneously a plurality of lines of row electrodes in a liquid crystal display device comprising a plurality of row electrodes and a plurality of column electrodes; and applying predetermined voltages to the selected lines of the row electrodes during a selection period, wherein the selection period of a display frame is divided so as to enable a time ratio of a first display frame to a second display frame to be different in two continuously displayed frames, and the selection period of at least a display frame is divided into divided selection periods such that any two divided selection periods of the selection period have a predetermined ratio, which is different than 1, the predetermined voltages are applied to the lines of row electrodes during the divided selection periods, and column electrodes are driven with a voltage pattern by reducing a number of changes of voltage levels in each of the divided selection periods.

* * * * *